US007748574B2

(12) United States Patent
Ophardt et al.

(10) Patent No.: US 7,748,574 B2
(45) **Date of Patent: *Jul. 6, 2010**

(54) CANTILEVERED SPRING

(75) Inventors: Heiner Ophardt, Vineland (CA); Abdul Vali Syed, Stoney Creek (CA); Andrew Jones, St. Catharines (CA); Tony Kortleve-Snider, Beamsville (CA)

(73) Assignee: GOTOHTI.COM, Beamsville, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/457,771

(22) Filed: Jun. 19, 2009

(65) Prior Publication Data

US 2010/0001023 A1 Jan. 7, 2010

Related U.S. Application Data

(63) Continuation of application No. 11/133,246, filed on May 20, 2005, now Pat. No. 7,568,598, which is a continuation-in-part of application No. 10/928,100, filed on Aug. 30, 2004, now Pat. No. 7,270,250.

(30) Foreign Application Priority Data

Aug. 12, 2004 (CA) ..... 2477584
Apr. 29, 2005 (CA) ..... 2505812

(51) Int. Cl.
*B67D 7/06* (2010.01)

(52) U.S. Cl. ..... 222/181.1; 222/340

(58) Field of Classification Search ..... 222/181.1, 222/181.3, 511–518, 472–474, 402.13, 402.15, 222/214, 340, 341, 173, 621, 628, 336–338
See application file for complete search history.

(56) References Cited

U.S. PATENT DOCUMENTS 3,066,832 A * 12/1962 Rossetti ..... 222/207

(Continued)

FOREIGN PATENT DOCUMENTS

EP 0209223 1/1987

(Continued)

*Primary Examiner*—Lien T Ngo
(74) *Attorney, Agent, or Firm*—Riches, McKenzie & Herbert LLP

(57) ABSTRACT

A spring mechanism comprising an elongate cantilevered spring member extending along a longitudinal coupled at a first end to a first member and with a distal, second end of the spring member engaging a second member such that the spring member biases the first and second members relative to each other. The spring member has an unbiased condition and being resiliently deflectable generally normal to its longitudinal to assume deflected conditions from which the spring member inherently attempts to return to its unbiased condition. The longitudinal of the spring member preferably remains disposed in a flat plane in deflecting of the spring member between the unbiased condition and the deflected conditions. The spring member preferably has, in cross-section normal to its longitudinal, a shape including two legs disposed to lie in planes parallel the flat plane and joined by a bight normal to the flat plane. Preferably, the spring member is provided with resiliency substantially by the resilient deflection of opposed portions of the two legs towards and/or away from each other normal to the flat plane. The spring member preferably consists of plastic material and may be formed as an integral element injection molded from plastic as a unitary element together with the first member to which it is coupled.

10 Claims, 27 Drawing Sheets

U.S. PATENT DOCUMENTS

| | | | | | |
|---|---|---|---|---|---|
| 3,828,982 | A | | 8/1974 | Steigerwald | |
| 3,884,457 | A | | 5/1975 | Leko | |
| 4,360,130 | A | | 11/1982 | Nishimura et al. | |
| 4,493,440 | A | | 1/1985 | von Buelow et al. | |
| 4,567,615 | A | | 2/1986 | Fanti | |
| 4,624,413 | A | * | 11/1986 | Corsette | 239/333 |
| 4,673,109 | A | | 6/1987 | Cassia | |
| 5,228,602 | A | * | 7/1993 | Maas et al. | 222/340 |
| 5,244,126 | A | | 9/1993 | Geier | |
| 5,282,552 | A | | 2/1994 | Ophardt | |
| 5,373,970 | A | | 12/1994 | Ophardt | |
| 5,431,309 | A | | 7/1995 | Ophardt | |
| 5,435,465 | A | | 7/1995 | El-Amin | |
| 5,445,288 | A | | 8/1995 | Banks | |
| 5,489,044 | A | | 2/1996 | Ophardt | |
| 5,638,989 | A | | 6/1997 | Ophardt | |
| 5,676,277 | A | | 10/1997 | Ophardt | |
| 5,706,984 | A | | 1/1998 | Tada et al. | |
| 5,785,303 | A | | 7/1998 | Kutschi | |
| 5,984,285 | A | | 11/1999 | Konig | |
| 6,164,494 | A | | 12/2000 | Marelli | |
| 6,409,050 | B1 | | 6/2002 | Ophardt | |
| 6,601,736 | B2 | | 8/2003 | Ophardt | |
| 6,669,184 | B2 | | 12/2003 | Cai | |
| 7,140,515 | B2 | | 11/2006 | Cardwell et al. | |

FOREIGN PATENT DOCUMENTS

| | | |
|---|---|---|
| EP | 0455431 | 11/1991 |
| GB | 0701223 | 12/1953 |
| GB | 1210515 | 10/1970 |
| GB | 1579617 | 11/1980 |
| GB | 2080884 | 2/1982 |
| GB | 2155435 | 9/1985 |
| GB | 2380470 | 4/2003 |
| WO | WO 96/14938 | 5/1996 |
| WO | WO 02/49490 | 6/2002 |

* cited by examiner

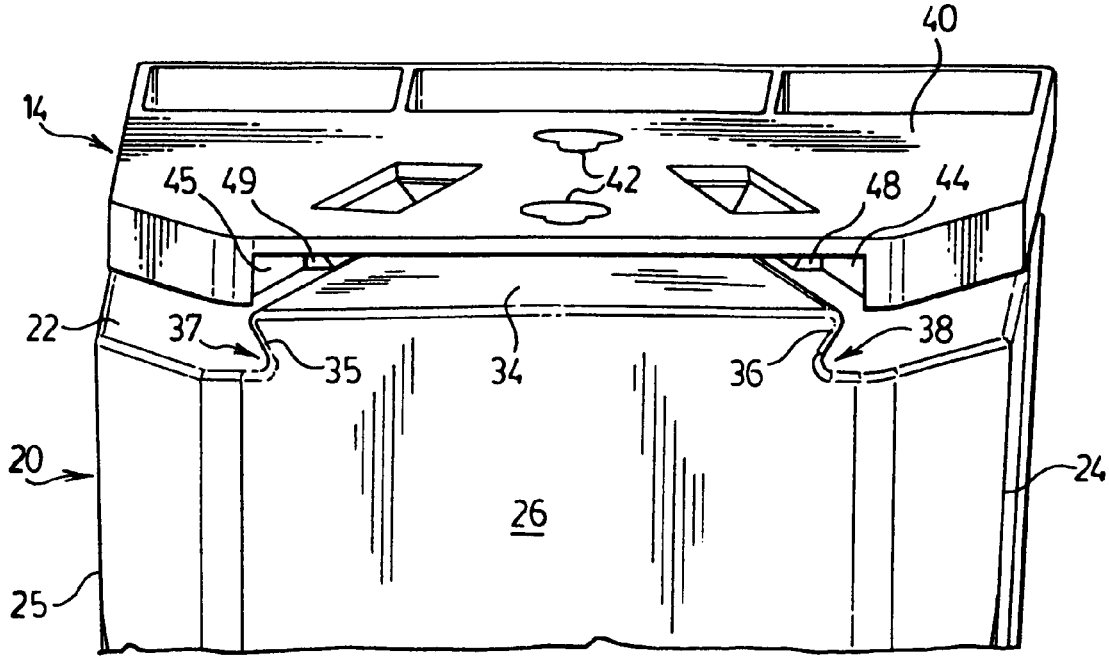
FIG.8.
FIG.9.
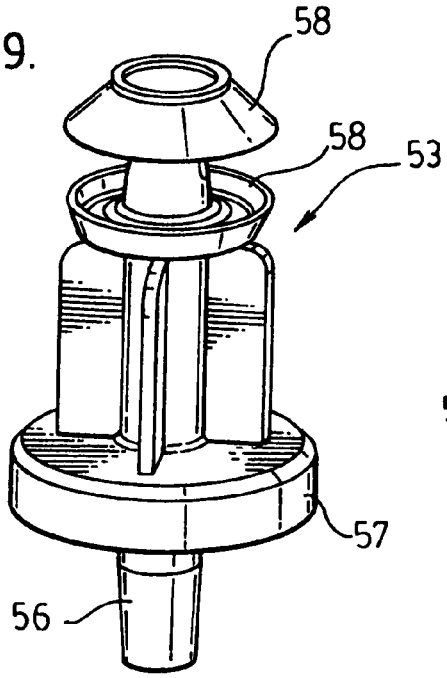
FIG.10.
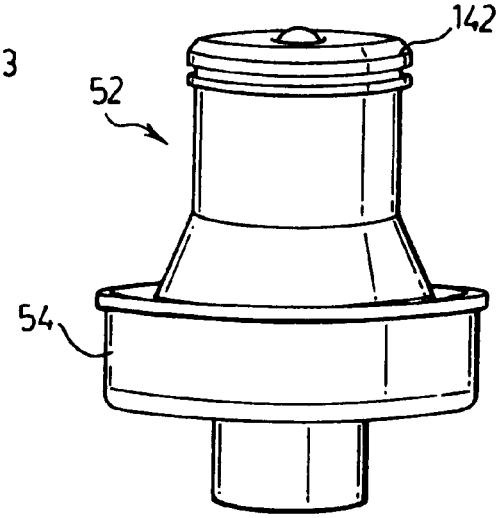

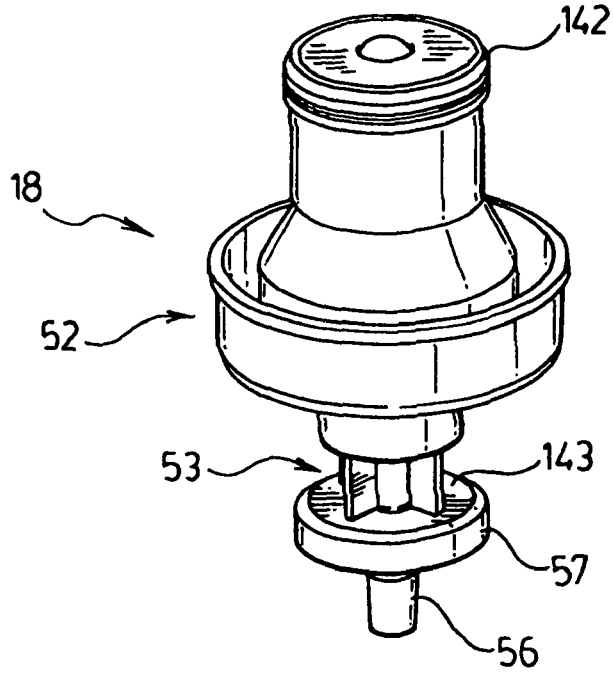
FIG.11.
FIG.12.
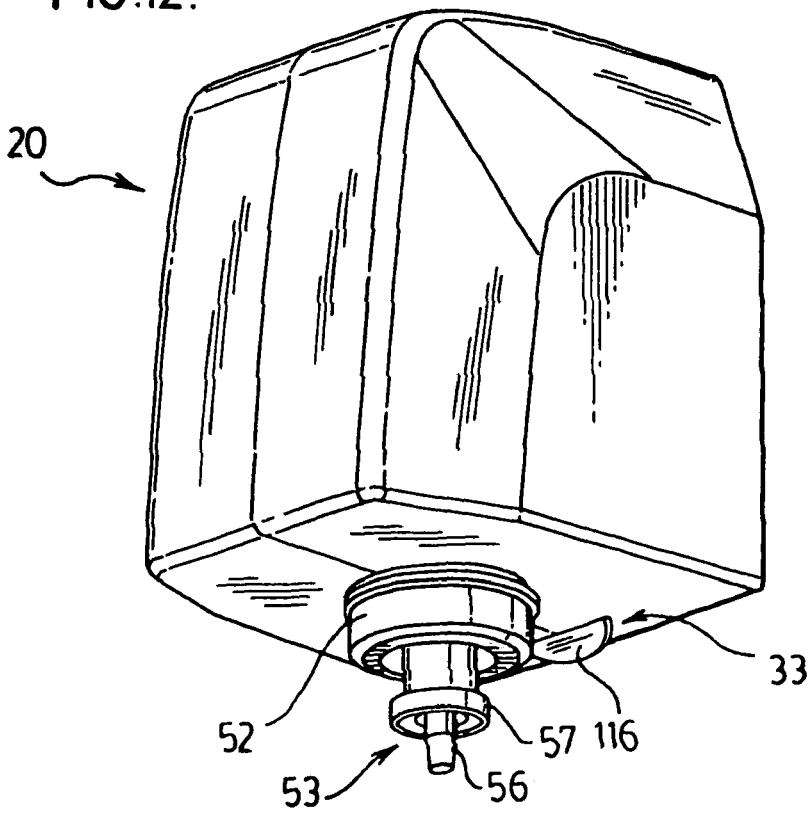

FIG. 25.
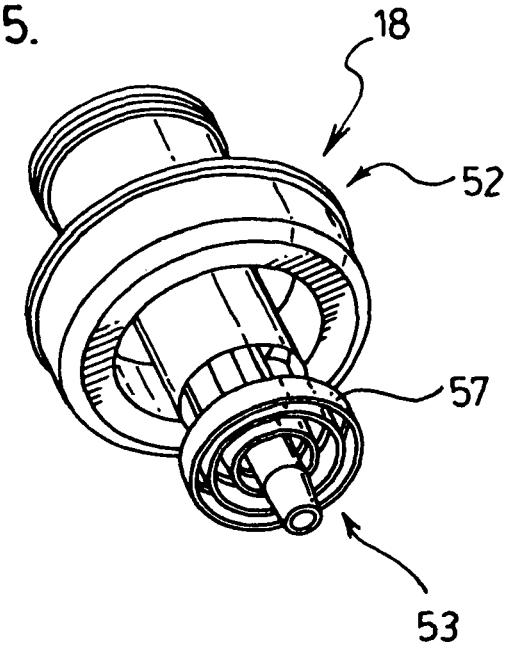
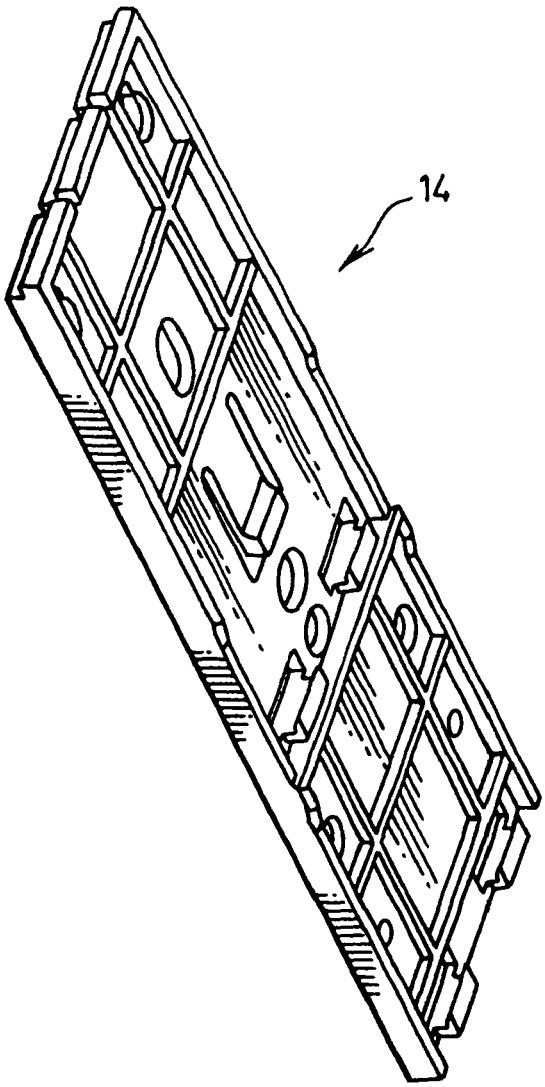
FIG. 26.

FIG. 32.
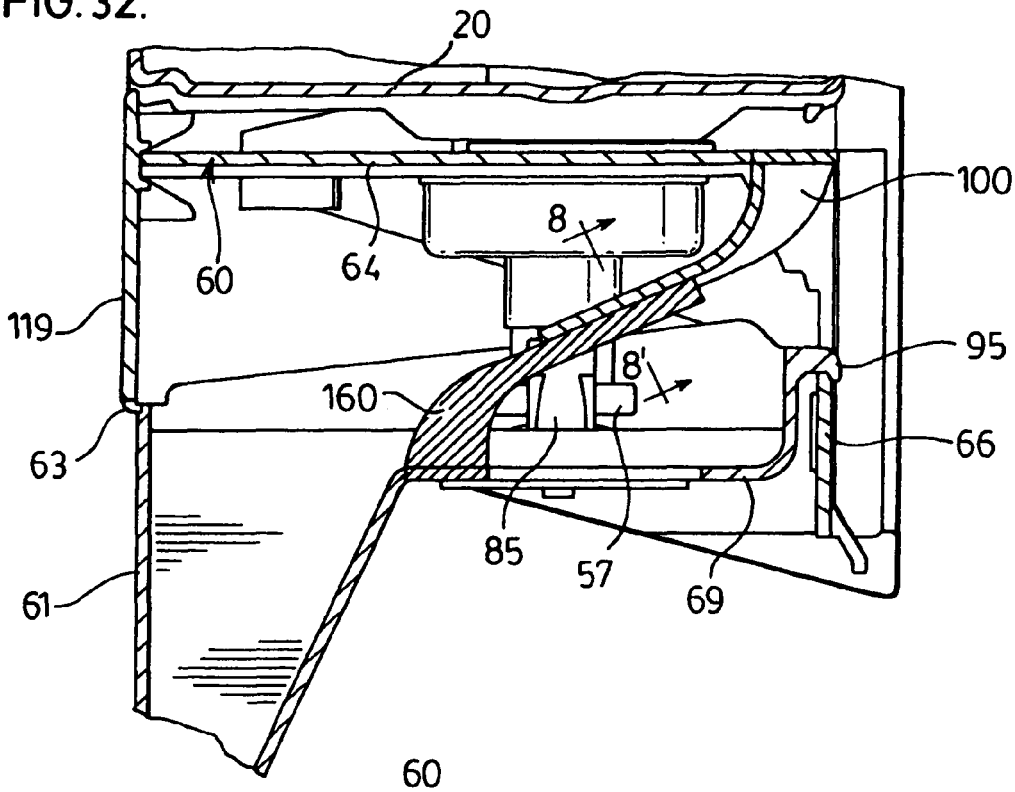
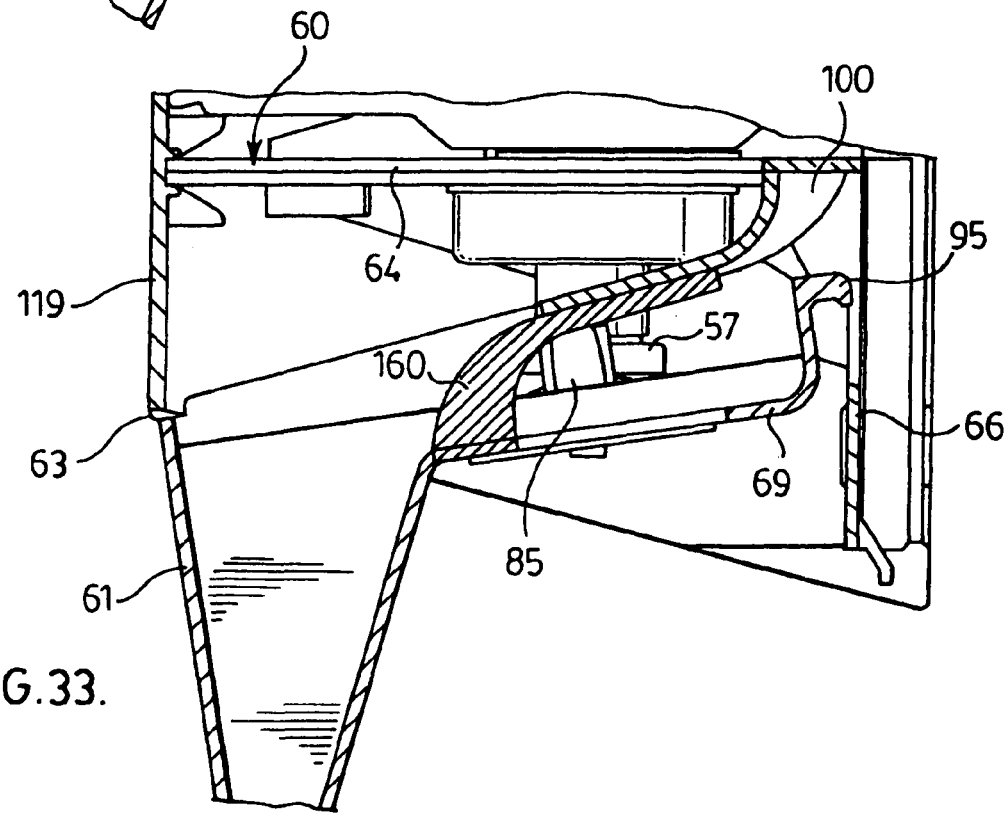
FIG. 33.

CANTILEVERED SPRING

RELATED APPLICATIONS

This application is a continuation application of U.S. application Ser. No. 11/133,246 filed May 20, 2005 now U.S. Pat. No. 7,568,598 which is a continuation-in-part of U.S. application Ser. No. 10/928,100 filed Aug. 30, 2004 now U.S. Pat. No. 7,270,250.

SCOPE OF THE INVENTION

This invention relates to a cantilevered spring and, more particularly, to a fluid dispenser with a cantilevered spring preferably of plastic.

BACKGROUND OF THE INVENTION

Various dispensers and other devices are well known with an actuator which is movable between a first position and a second position with a spring biasing the actuator to a first position and with the actuator being movable to the second position against the bias of the spring and then returning under the resiliency of the spring to the second position. Typical springs include metal springs which are selected in view of the inherent resiliency of the metal and the fact that spring metals are well known to provide for a long useful life against failure. Wall mounted soap dispensers for use in washrooms and the like are known in which a manually activated presser is movable between an extended position and a retracted position to dispense material and a spring is provided to return the presser to one of these positions. Most commonly used springs comprise metal helical coil springs.

Many dispensers are formed substantially from plastic which is recyclable. Insofar as a soap dispenser may be formed substantially from plastic other than a metal spring, the metal spring provides the disadvantage of reducing the ease with which the dispenser can be recycled as, for example, to be reground and the plastic reused. The metal spring needs to be separately removed before any such grinding process.

Provision of a separate spring, whether or not metal, has a disadvantage of requiring a separate part which requires separate manufacture, inventory and assembly.

SUMMARY OF THE INVENTION

To at least partially overcome these disadvantages of previously known devices, the present invention provides a construction for a cantilevered spring and, more particularly, a cantilevered spring construction adapted to be manufactured from plastic preferably as an integral part of a dispensing unit.

An object of the present invention is to provide an improved construction for an elongate cantilevered spring.

Another object is to provide a construction for a plastic spring.

Another object is to provide an improved dispenser incorporating an elongate cantilevered spring member.

The present invention provides a spring mechanism comprising an elongate cantilevered spring member extending along a longitudinal coupled at a first end to a first member and with a distal, second end of the spring member engaging a second member such that the spring member biases the first and second members relative to each other. The spring member has an unbiased condition and is resiliently deflectable generally normal to its longitudinal to assume deflected conditions from which the spring member inherently attempts to return to its unbiased condition. The longitudinal of the spring member preferably remains disposed in a flat plane in deflecting of the spring member between the unbiased condition and the deflected conditions. The spring member preferably has, in cross-section normal to its longitudinal, a shape including two legs disposed to lie in planes parallel the flat plane and joined by a bight normal to the flat plane. Preferably, the spring member is provided with resiliency substantially by the resilient deflection of opposed portions of the two legs towards and/or away from each other normal to the flat plane. The spring member preferably consists of plastic material and may be formed as an integral element injection molded from plastic as a unitary element together with the first member to which it is coupled.

The present invention further provides a dispenser of flowable materials comprising a support member, an actuator, a member reciprocally movable relative the support member between an extended position and a retracted position to dispense the flowable material, and a spring mechanism comprising a spring member biasing the actuator member to one of the extended position and the retracted position wherein the spring mechanism comprises an elongate cantilevered spring member extending along a longitudinal coupled at a first end to a first of the support member and the actuator member and with a distal, second end engaging the other, second of the support member and the actuator member. Preferably, the spring member together with the first of the presser member and the support member comprises a unitary element injection molded from plastic as a unitary element. Preferably, the spring mechanism comprises two identical spring sets, spaced from each other.

In one aspect, the present invention provides a dispenser for flowable materials comprising:

a support member, an actuator member reciprocally movable relative to the support member between an extended position and a retracted position to dispense flowable material, a spring mechanism comprising a spring member biasing the actuator member to one of the extended position and the retracted position, the spring member comprising an elongate cantilevered spring member extending along a longitudinal coupled at one first end to a first of the support member and the actuator member and with a distal, second end engaging the other, second of the support member and the actuator member.

In another aspect, the present invention provides a dispenser for flowable materials comprising:

a support member, an actuator member reciprocally movable relative to the support member between an extended position and a retracted position to dispense flowable material, a spring mechanism biasing the actuator member to one of the extended position and the retracted position, a spring mechanism comprising a first spring member and a second spring member, the first spring member comprising an elongate cantilevered leaf spring member extending along a longitudinal of the first spring member from a first end thereof which merges into the support member toward the actuator member to a distal second end thereof, the first spring member having an unbiased condition and being resiliently deflectable generally normal to its longitudinal to deflected conditions from which the first spring member inherently attempts to return to its unbiased condition, the second spring member comprising an elongate cantilevered leaf spring member extending along a longitudinal of the second spring member from a first end thereof which merges into the actuator member toward the support member to a distal second end thereof, the second spring member having an unbiased condition and being resiliently deflectable generally normal to its longitudinal to deflected conditions from which the second spring member inherently attempts to return to its unbiased condition, the first spring member proximate the distal end thereof engaging the second spring member proximate the distal end thereof to interact as a combined double leaf spring.

BRIEF DESCRIPTION OF THE DRAWINGS

Further aspects and advantages of the present invention will become apparent from the following description taken together with the accompanying drawings in which:

FIG. 8 is a pictorial top view of the dispenser as shown in FIG. 1 with the bottle in the position of being inserted onto the wall;

FIG. 9 is a pictorial view of a piston member used in the embodiment of FIG. 1;

FIG. 10 is a pictorial view of a piston chamber forming element used in the embodiment of FIG. 1;

FIG. 11 is a pictorial view of an assembled pump mechanism formed by assembly of the piston member of FIG. 9 and the piston chamber forming member of FIG. 10;

FIG. 12 is a pictorial view of the bottle of FIG. 4 with the pump mechanism of FIG. 11 coupled thereto;

FIG. 25 is a perspective view of a pump used with the dispenser of FIG. 23;

FIG. 26 is a pictorial view of a back plate of the dispenser of FIG. 23;

FIG. 32 is an enlarged cross view of portions of FIG. 31;

FIG. 33 is a cross-sectional side view the same as FIG. 32, however, showing the presser member pivoted inwardly;

DETAILED DESCRIPTION OF THE DRAWINGS

Figure 1:
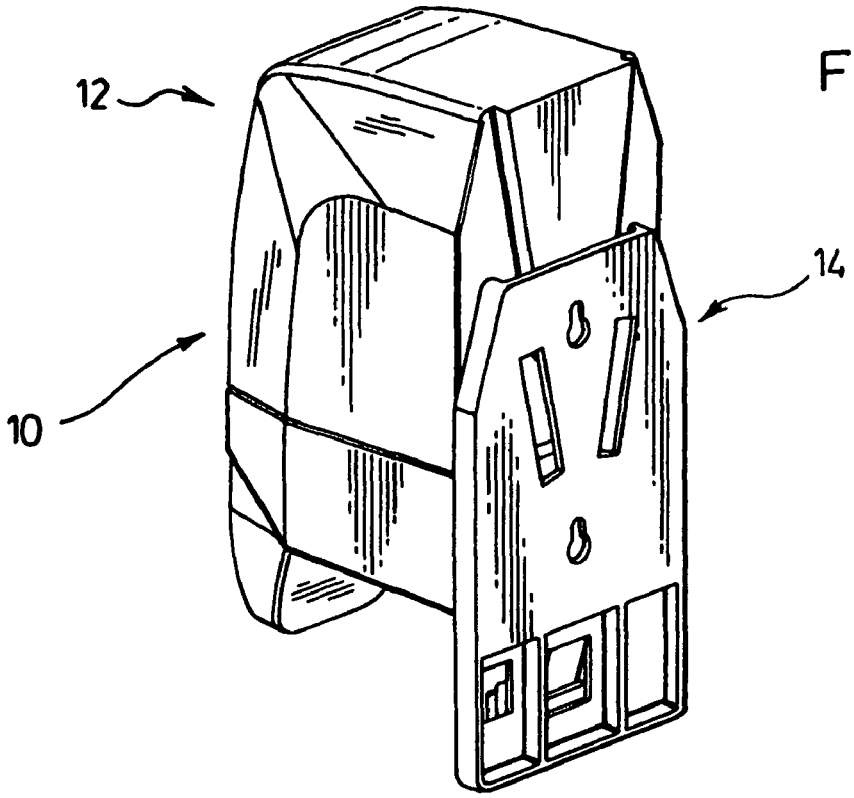
FIG. 1 is a schematic rear perspective view showing a dispenser in accordance with the first embodiment of the present invention with an assembled dispensing unit in the process of being mounted to a wall plate.
Figure 2:
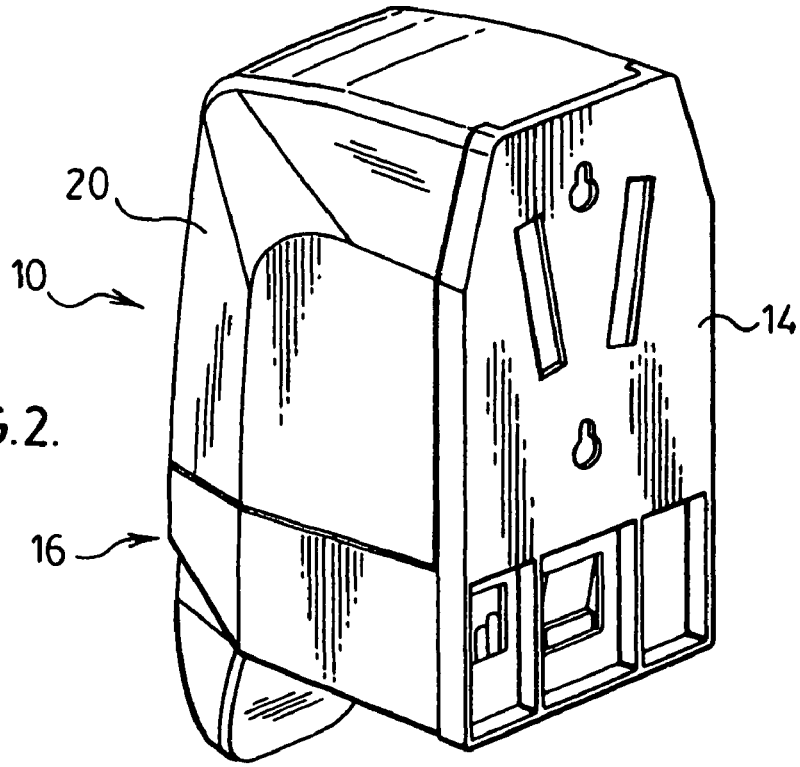
FIG. 2 shows a schematic pictorial rear and side view of the dispenser of FIG. 1 from above with the dispensing unit fully mounted on the wall plate.
Figure 3:
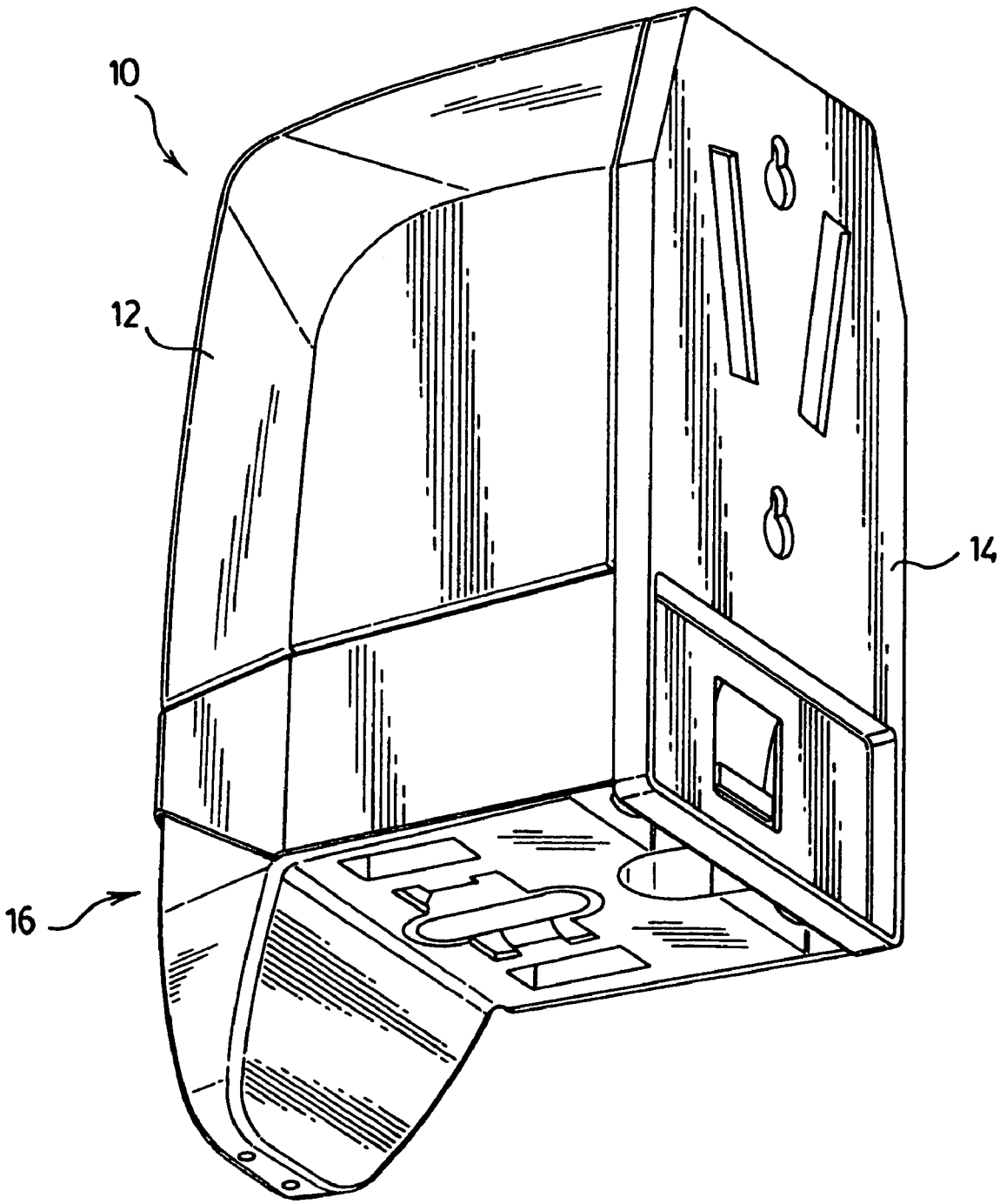
FIG. 3 shows a schematic pictorial rear and side view of the dispenser of FIG. 2 from below.

Reference is made to FIGS. 1 to 21 which show a first embodiment of a soap dispenser 10 comprising a dispensing unit 12 removably coupled to a wall plate 14. The dispensing unit 12 comprises an assembly of a reservoir bottle 20, a piston pump mechanism 18 and an activator member 16.

Bottle

Figure 4:
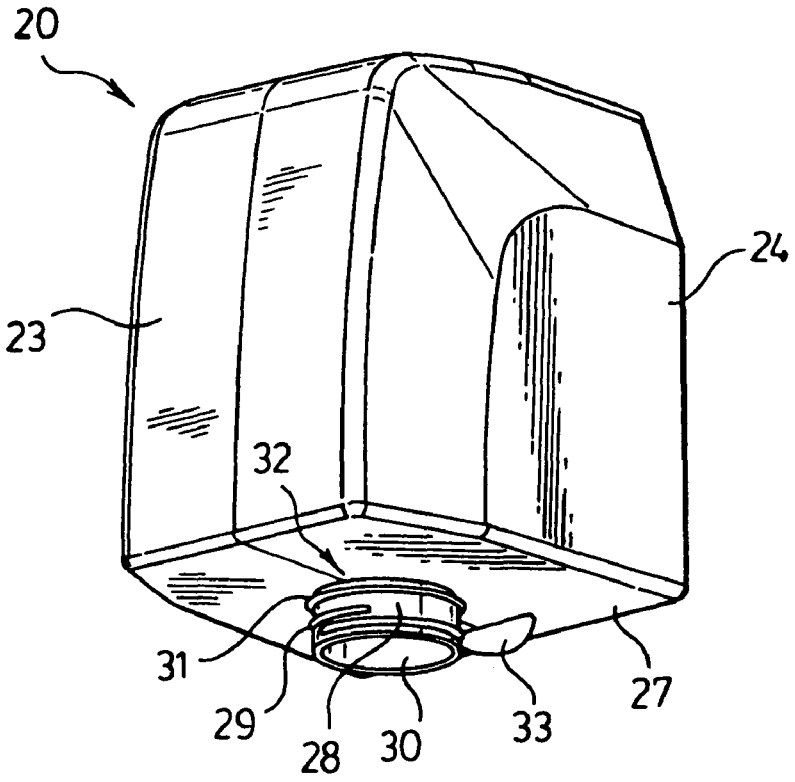
FIG. 4 shows a pictorial bottom and front view of the bottle of the dispenser of FIG. 1 from below.
Figure 5:
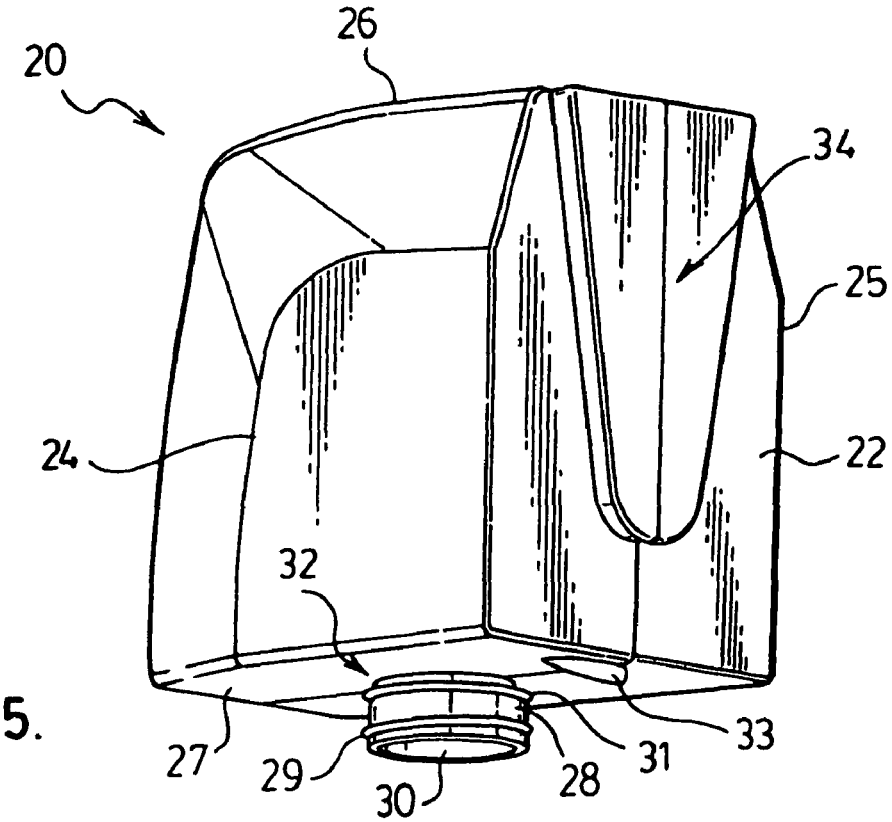
FIG. 5 is a pictorial bottom and rear view of the bottle of FIG. 4 from below.
Figure 6:
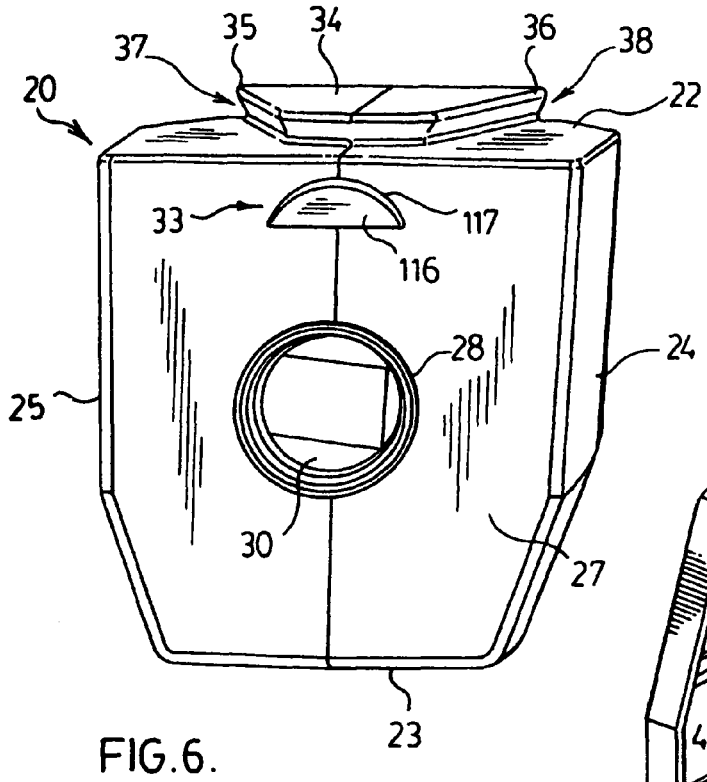
FIG. 6 is a pictorial bottom view of the bottle of FIG. 4.

The reservoir bottle 20 is best shown in FIGS. 4 to 6. The bottle 20 has a rear wall 22, a forward wall 23, two side walls 24 and 25, a top wall 26 and a bottom wall 27. A cylindrical externally threaded neck 28 carrying helical threads 29 extends downwardly from the bottom wall 27 and provides an exit opening 30 for communication with the interior of the bottle.

The neck 28 also carries an annular flange 31 spaced a uniform distance from the bottom wall 27 so as to provide an annular slotway 32 therebetween adapted for coupling the bottle 20 to the activator member 16.

The bottom wall 27 has a catch ramp 33 to engage the activator member 16 in a manner to resist uncoupling of the bottle 20 from the actuator member 16.

The rear wall 22 of the bottle carries a mounting wedge 34 which has spaced side walls 35 and 36, best seen in FIGS. 6 and 8, which are undercut in the sense that they provide laterally inwardly extending slotways 37 and 38 for coupling of the bottle to the wall plate 14.

The configuration of the mounting wedge 34 is preferably adapted to facilitate manufacture of the bottle 20 by blow molding from relatively inexpensive plastic materials such as polyethylene, preferably low density polyethylene yet provide for secure coupling of the bottle 20 to the wall plate 14.

Wall Plate

Figure 7:
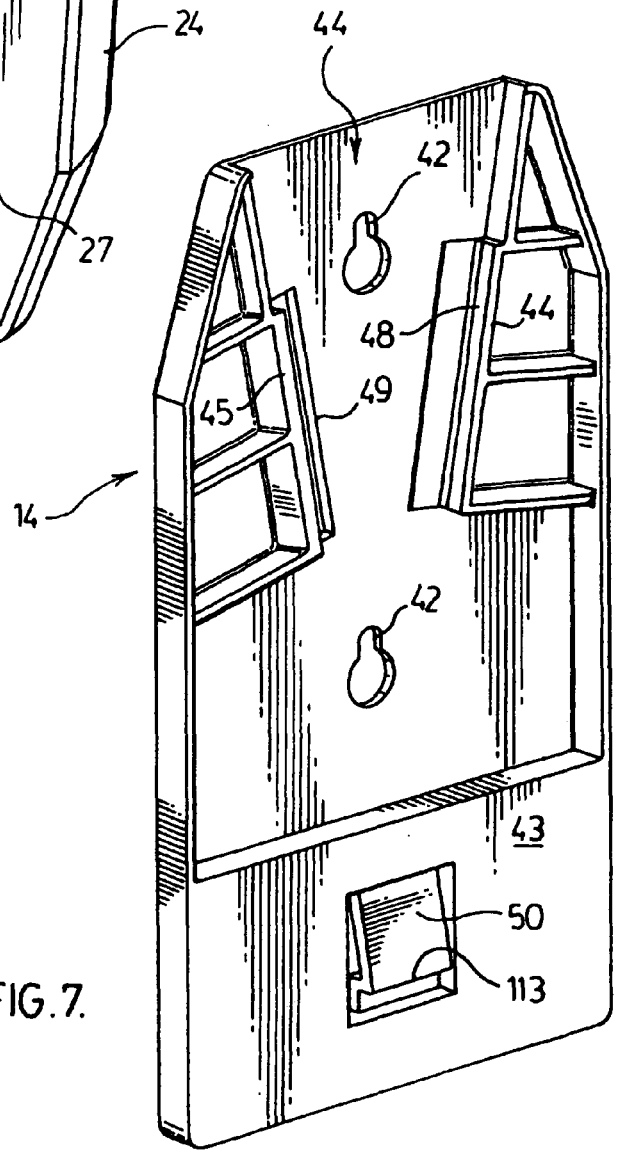
FIG. 7 is a pictorial front view of the wall plate of the dispenser of FIG. 1.

The wall plate 14 is best seen in FIGS. 7 and 8. The wall plate has a planar rear surface 40 for engagement as, for example, with a washroom wall proximate a sink. The wall plate 14 may be secured to the wall by known means, preferably, by adhesives such as two-sided adhesive tape or fasteners such as screws. Openings 42 to receive such fasteners are shown to extend through the wall plate 14.

The forward surface 43 of the wall plate carries a wedge-shaped slot 44 defined between two angled shoulder forming members 45 and 46 which each present a laterally and inwardly extending catch member 48 and 49 which are adapted to be received in the slotways 37 and 38 of the bottle 20. The slot 44 is complementary in size and shape to the mounting wedge 34 on the bottle.

The bottle 20 is removably mounted to the wall plate 14 by aligning the mounting wedge 34 on the bottle 20 with the groove 44 on the wall plate 14 and sliding the bottle 20 vertically downwardly. The wall plate 14 preferably carries a resilient deflectable cantilevered shoulder carrying latch finger 50 adapted to releaseably lock the wall plate 14 to the activator member 16.

As seen in FIG. 8, the mounting wedge 34 on the bottle 20 provides a dovetail-like member to be received in the dovetail-like slot 44 in the wall plate 14.

Pump Mechanism

As seen schematically in FIGS. 9 to 12, the pump mechanism 18 comprises a piston chamber forming element 52 and a piston member 53. The piston chamber forming element 52 is adapted to be sealably engaged in the exit opening 30 of the bottle 20 by reason of an internally threaded flange 54 threadably engaging the threaded neck 28 of the bottle 20 and locating the piston chamber forming element coaxially within the neck 28. The piston member 53 is axially slidably received in the piston chamber forming element 52 for axial sliding therein coaxially between an extended position and a retracted position to dispense flowable materials from the bottle 20.

Figure 21:
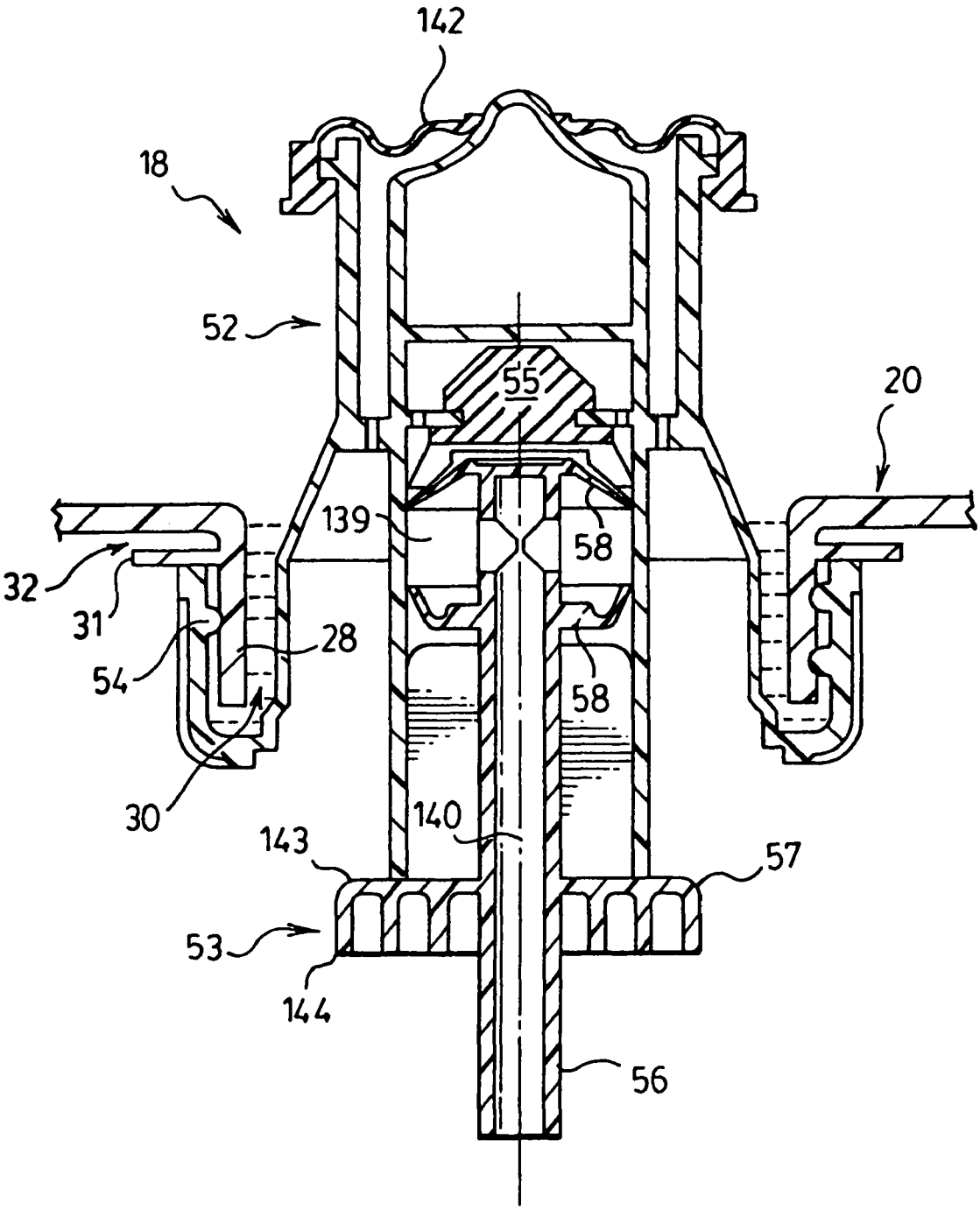
FIGS. 21 and 22 are cross-sectional side views through the pump assembly and bottle as shown in FIG. 12 through cross-sections coaxial with the neck of the bottle and including but a small section of the bottom wall of the bottle.
Figure 22:
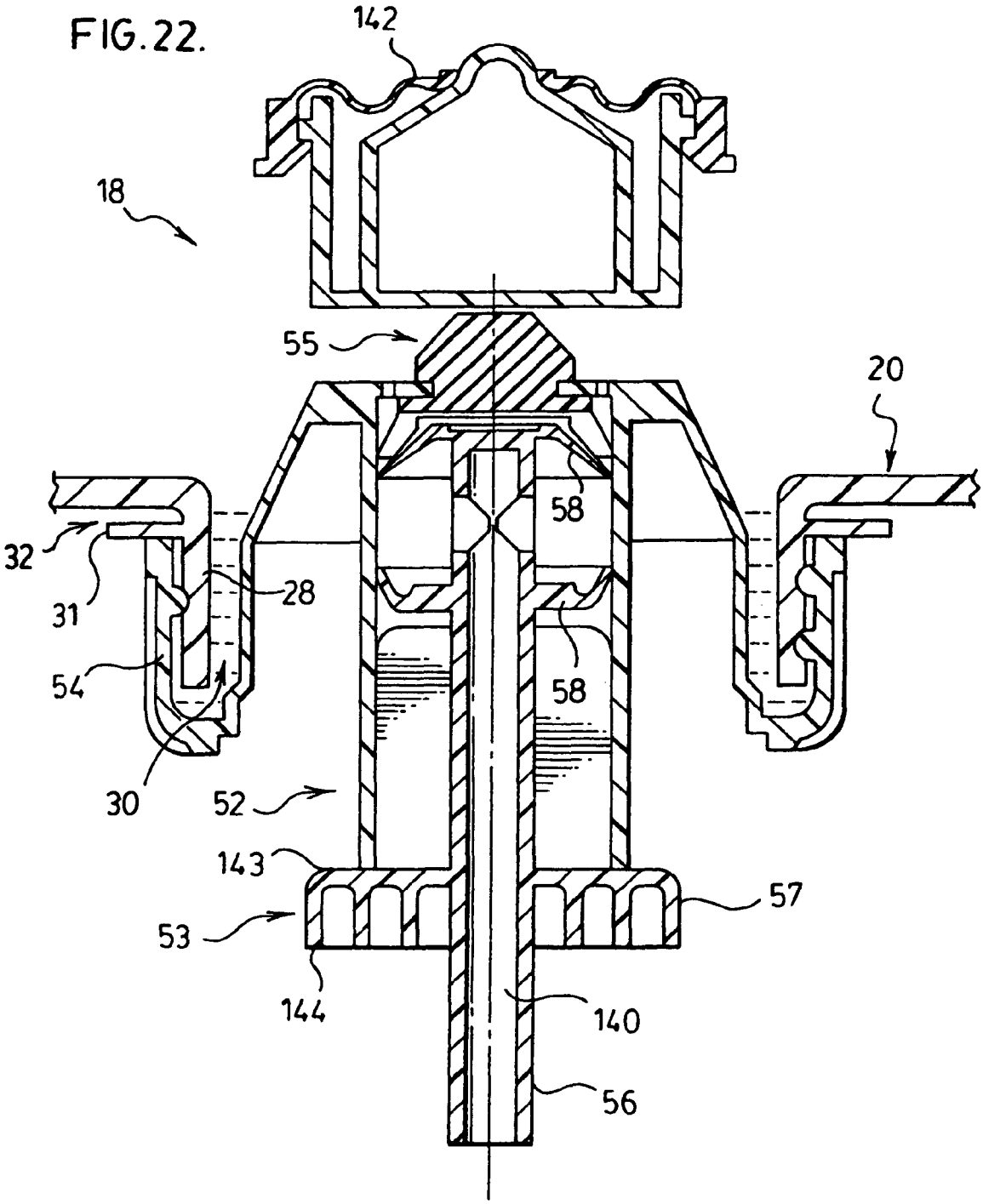
Figure 23:
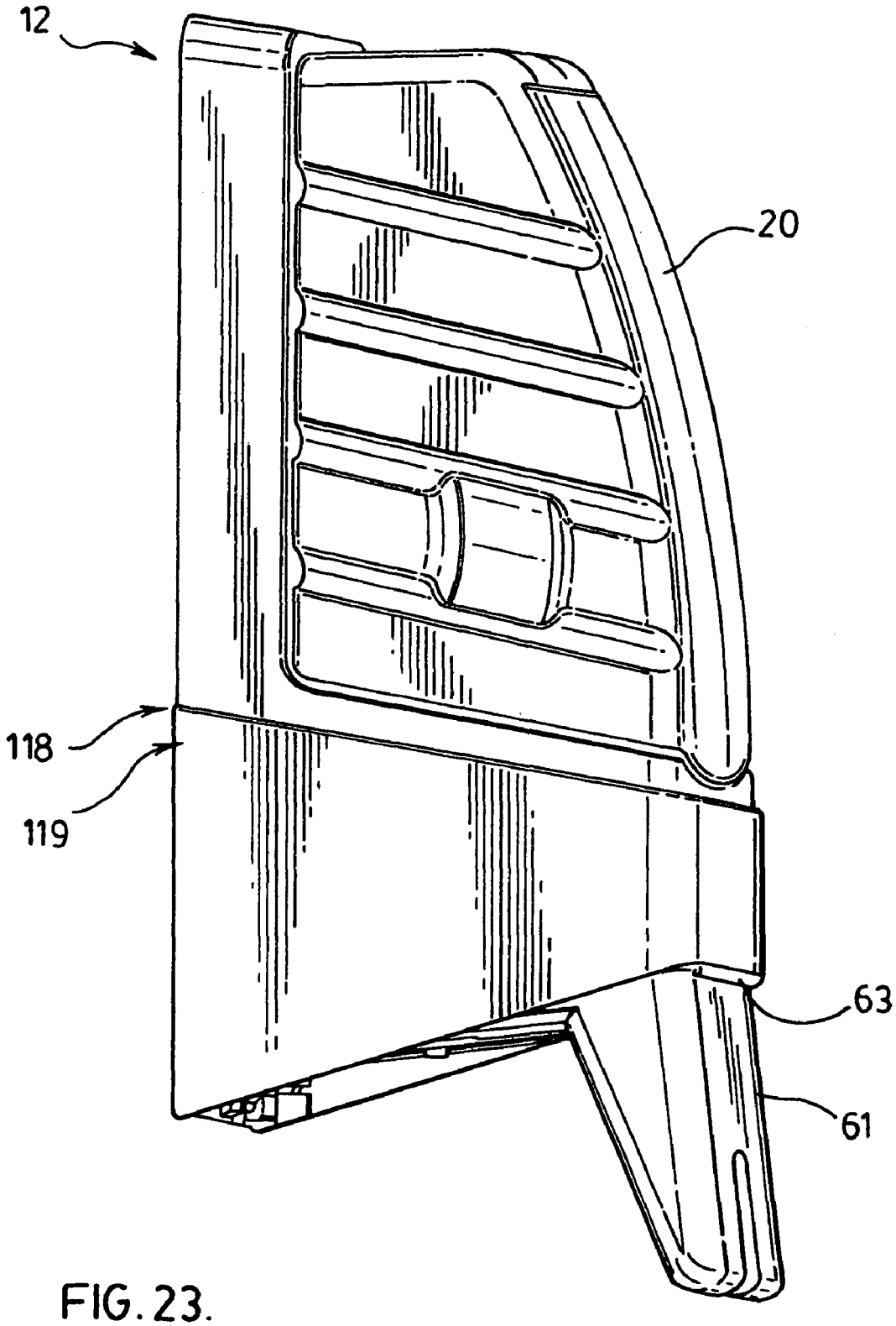
FIG. 23 is a perspective view of the dispenser in accordance with a second embodiment of the present invention fully assembled.

FIGS. 21 and 22 show cross-sectional views of a complete pump mechanism 18 coupled to the bottle 20 shown schematically. The piston chamber forming element 52 carries one-way inlet valve 55 via which material in the bottle may pass into a chamber 139 inside the piston chamber forming element 53. The piston member 53 has an outlet extension tube 56 extending outwardly from the piston chamber forming element 52 and carrying an annular engagement flange 57 for engagement to reciprocally move the piston member 53. The piston member 53 has radially outwardly directed flanges 58 to interact with the chamber 139 inside the piston chamber forming element 52 so as to dispense material out through an outlet passageway 140 centrally through the outlet extension tube 56. The piston pump mechanism 18 preferably includes a resilient air relief valve 142 to permit air to enter the bottle 20 to replace material dispensed as when vacuum conditions are created inside the bottle 20 which is preferably configured to be rigid or substantially non-collapsible.

The pump mechanism illustrated is of a type similar to that disclosed in the applicant's U.S. Pat. No. 5,282,522, issued Feb. 1, 1994, the disclosure of which is incorporated herein by reference. Various other similar piston pumps may be used as, for example, disclosed in the applicant's U.S. Pat. No. 5,676,277, issued Oct. 14, 1997 preferably for dispensing liquids and U.S. Pat. No. 6,601,736, issued Aug. 5, 2003 preferably for dispensing foam liquid, the disclosures of which are incorporated herein by reference. Other similar piston pump mechanisms adapted for coupling to the outlet of bottles are well known. It is preferred to adopt pump mechanisms which are made entirely out of plastic and do not incorporate any metal components. The pump mechanisms may include pump mechanisms which permit dispensing of more than one component in a dispensing stroke and may dispense flowable solid and grit-like materials alone or in combination with paste, liquids or flowable materials or foamed liquids. As well, the pump mechanism may provide a nozzle at the end of the extension tube 56 which provides for spraying of the fluid dispensed.

Actuator Member

Figure 13:
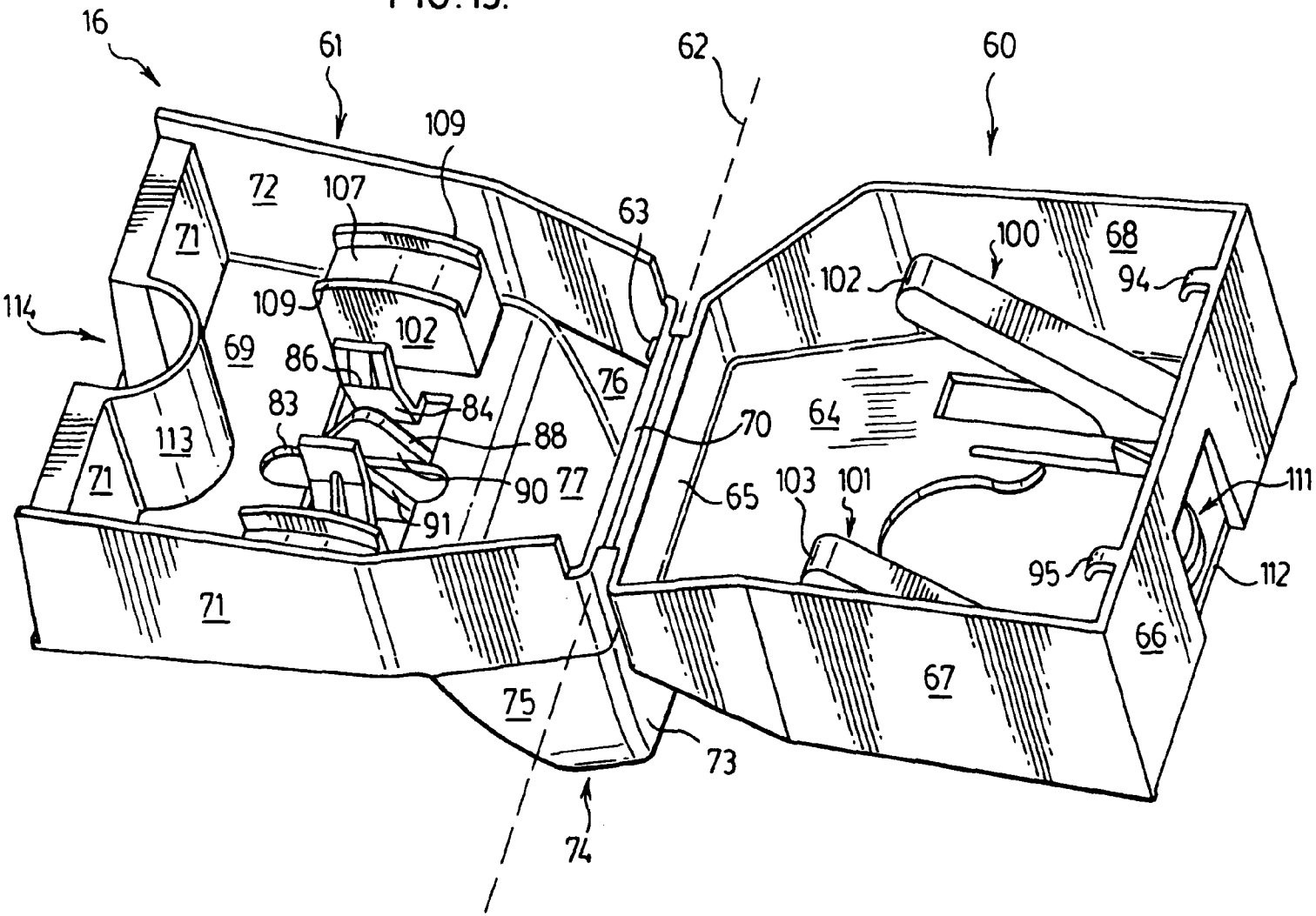
FIG. 13 is a pictorial view of the actuator member of the dispenser of FIG. 1 in an open position.
Figure 14:
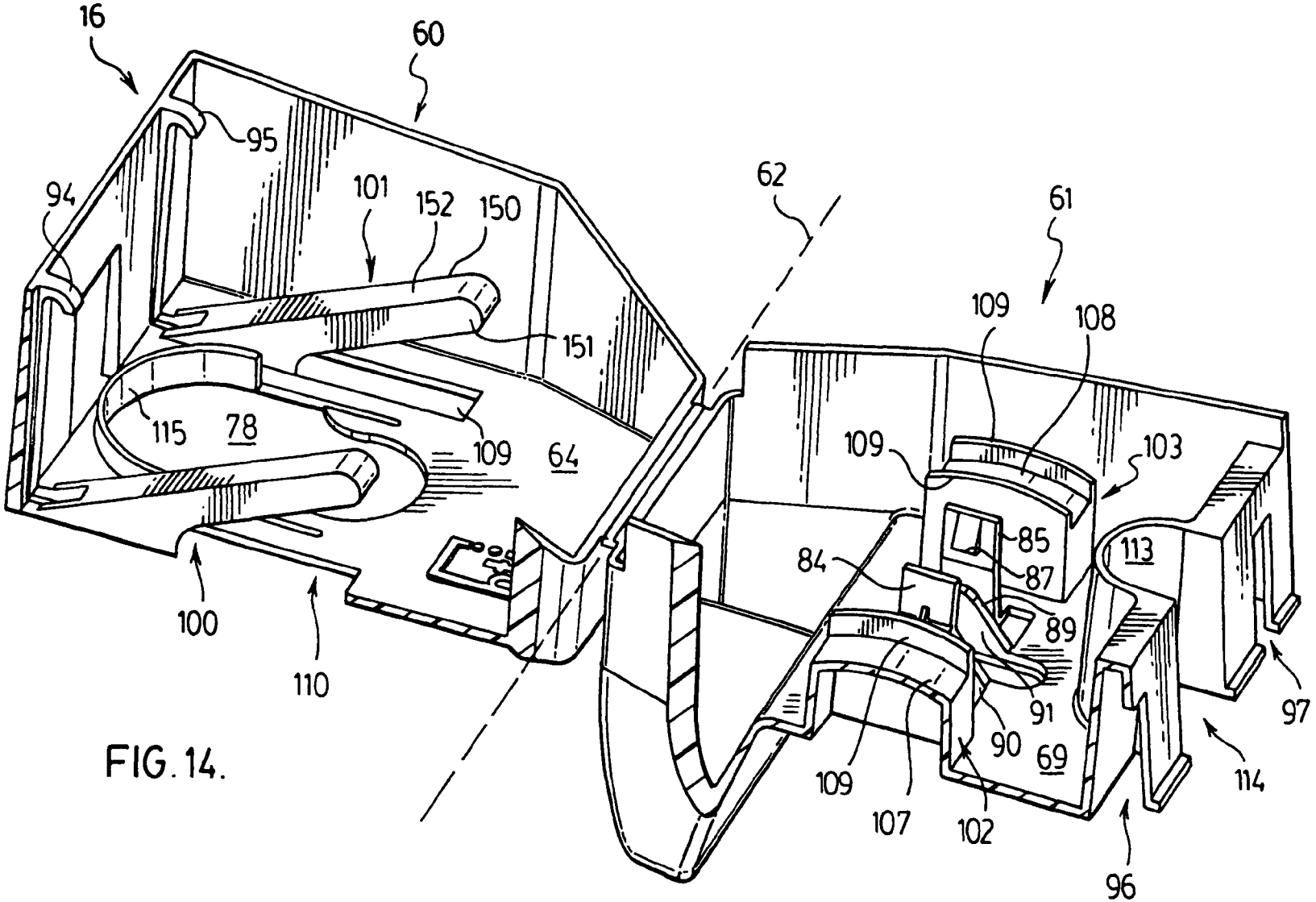
FIG. 14 is a partially cross-sectioned pictorial view of the actuator of FIG. 13 as viewed from the other side of the actuator to that viewed in FIG. 13.
Figure 15:
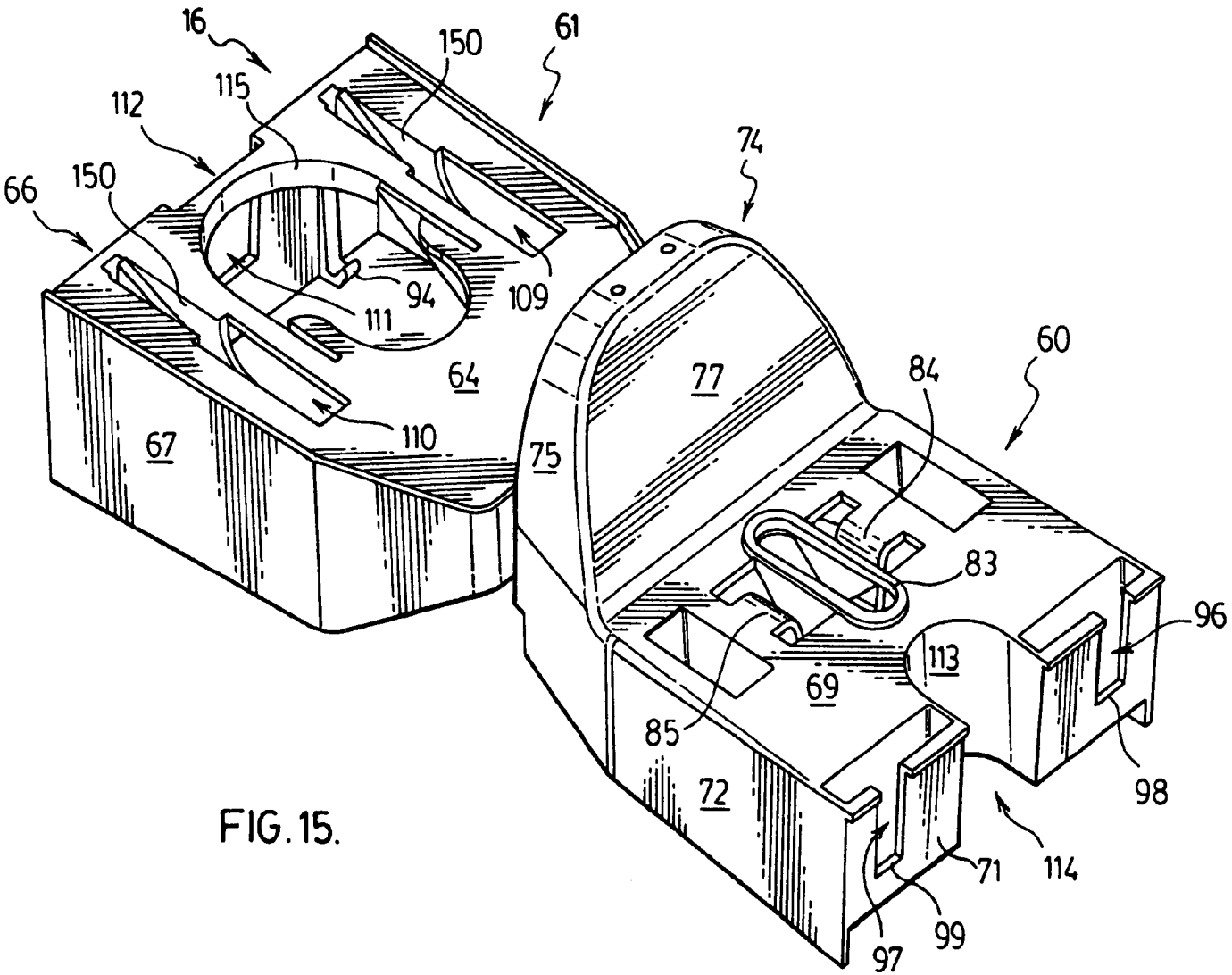
FIG. 15 is a pictorial view of the underside of the actuator member shown in FIG. 13.

The actuator member 16 is shown in FIGS. 13 to 19. The actuator member 16 in the preferred embodiment comprises a unitary element preferably injection molded from plastic. The actuator member comprises a support member 60 and a presser member 61 pivotally coupled together for pivoting about a hinge axis 62 by a living hinge 63 which is a thin plate of plastic which bridges between the support member 60 and the presser member 61. The activator member 16 is shown in FIGS. 13, 14 and 15 with the support member 60 and the presser member 61 disposed about the hinge axis 62 in an open position, being a position in which the activator member is preferably formed during injection molding. From the open position shown in FIGS. 13 to 15, the actuator member is folded about the hinge axis 62 to assume closed, operative positions for dispensing use as shown in FIGS. 16 to 19.

Figure 16:
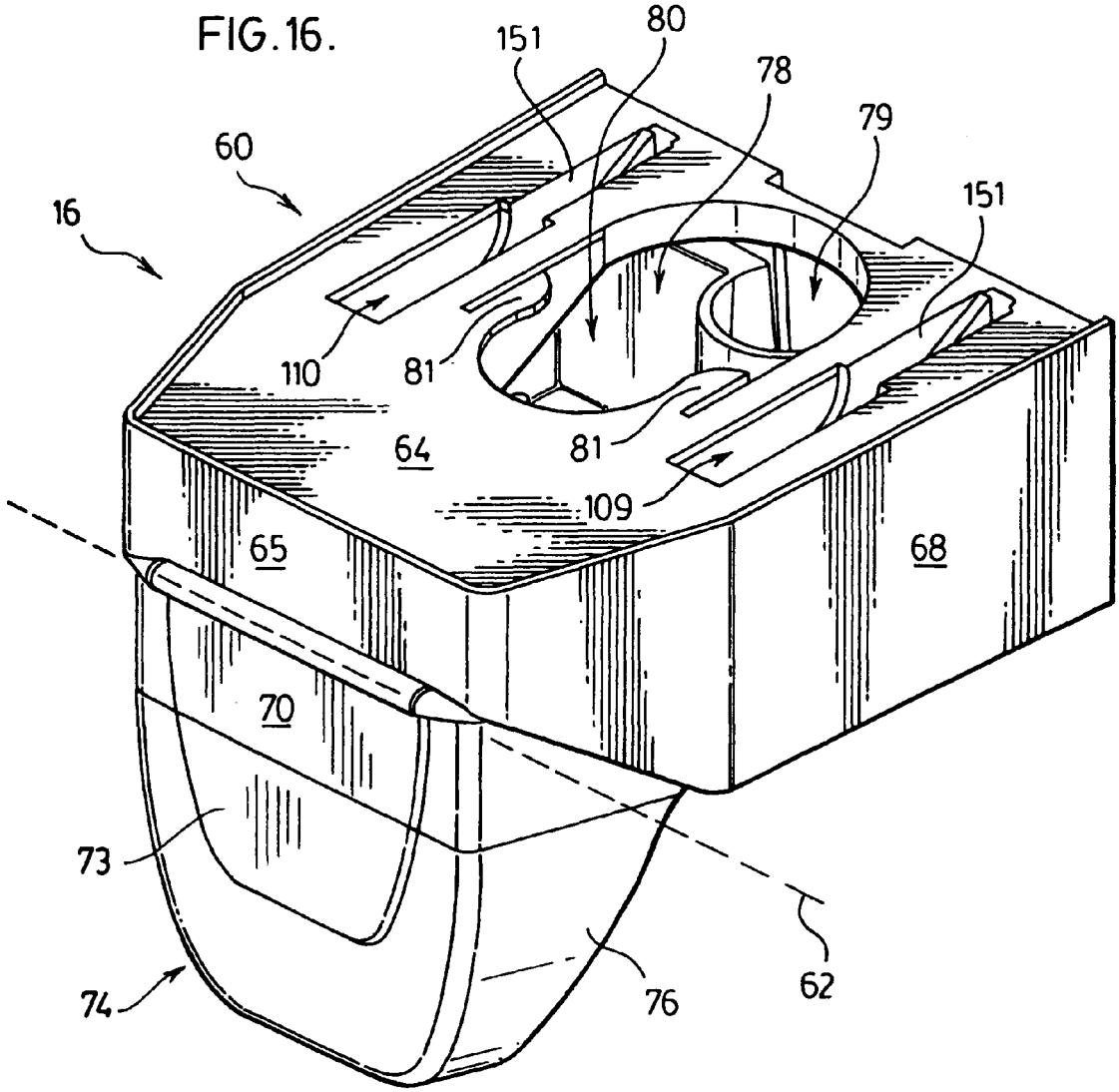
FIG. 16 is a pictorial view of the actuator of FIG. 13 in a closed position.
Figure 17:
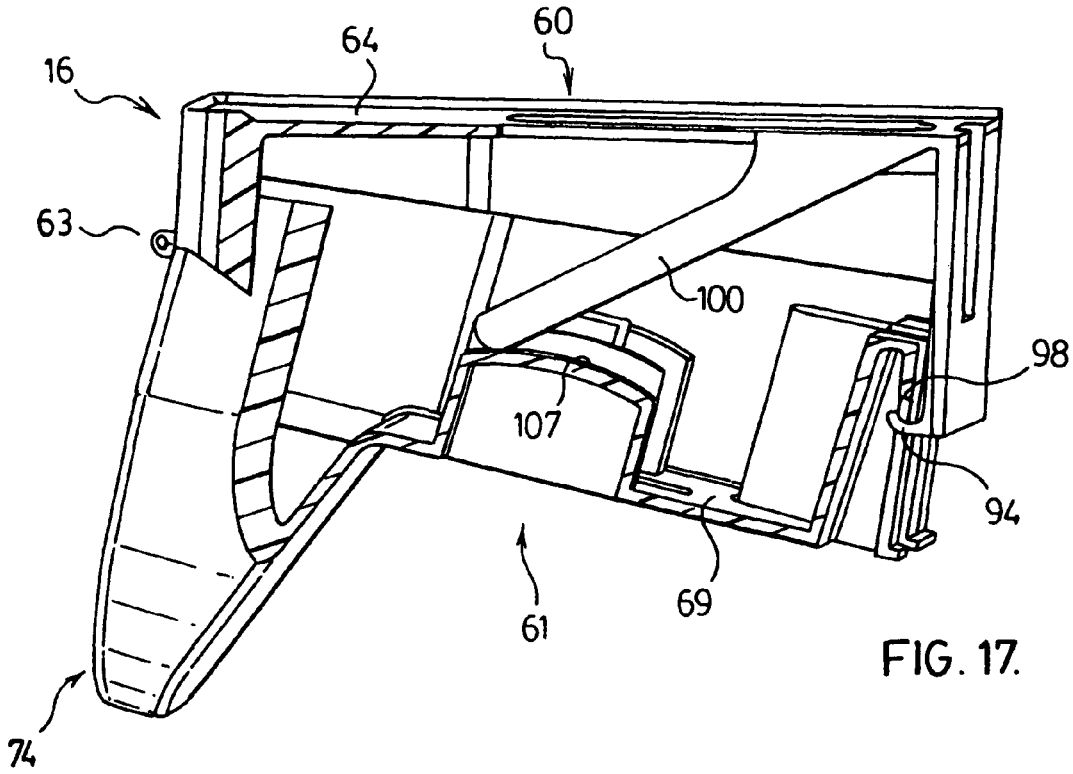
FIG. 17 is a cross-sectional side view of the actuator of FIG. 16 as cross-sectioned adjacent one spring member.
Figure 18:
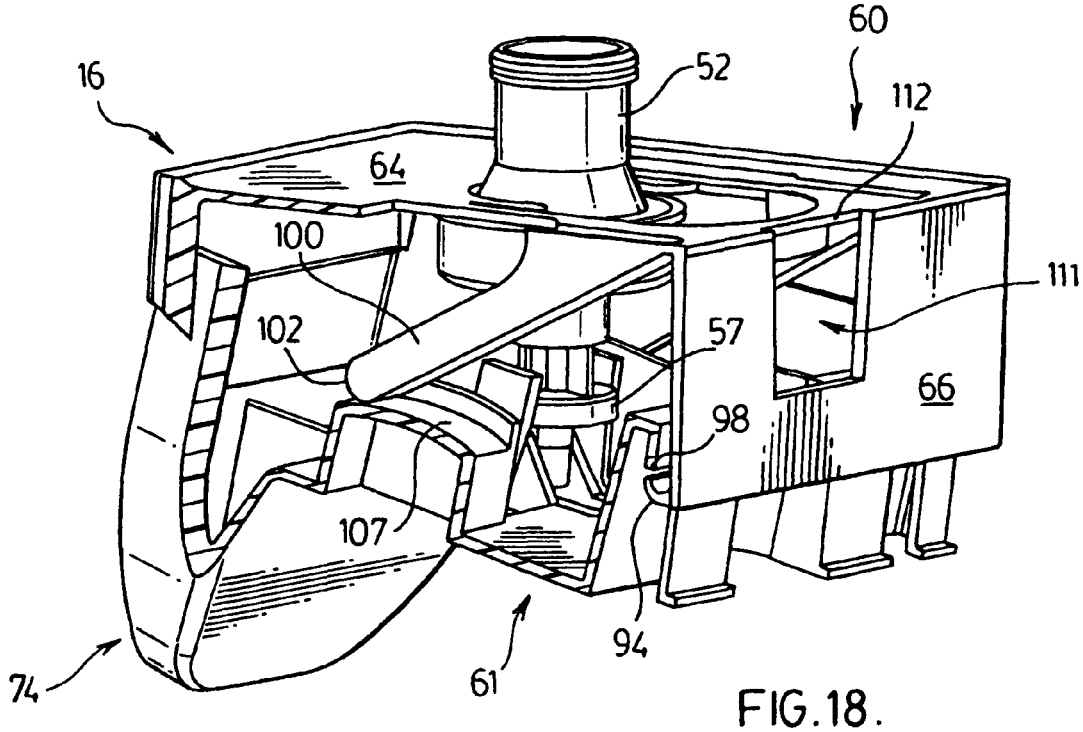
FIG. 18 is a pictorial partially cross-section side view of the actuator member shown in FIG. 16 in a fully extended position and showing the location of the pump mechanism of FIG. 11 if the pump mechanism were received within a bottle coupled to the actuator member.
Figure 19:
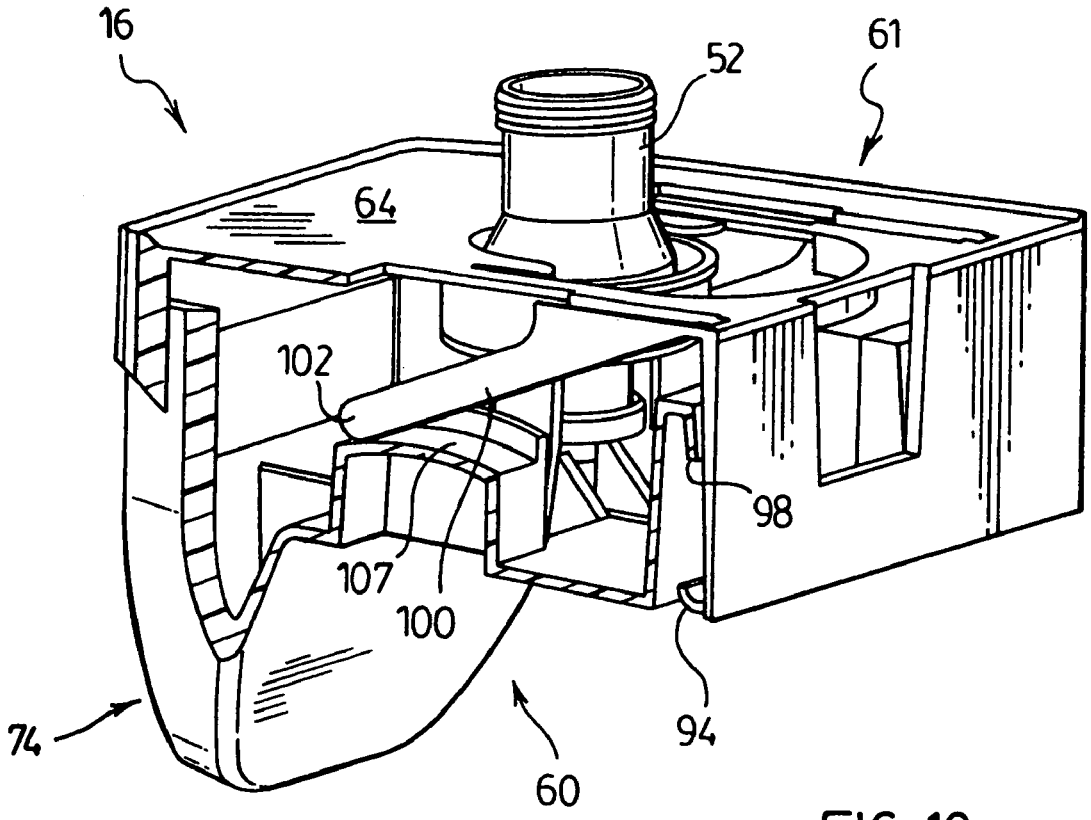
FIG. 19 is a view the same as that of FIG. 17, however, with the actuator member in a retracted position.
Figure 20:
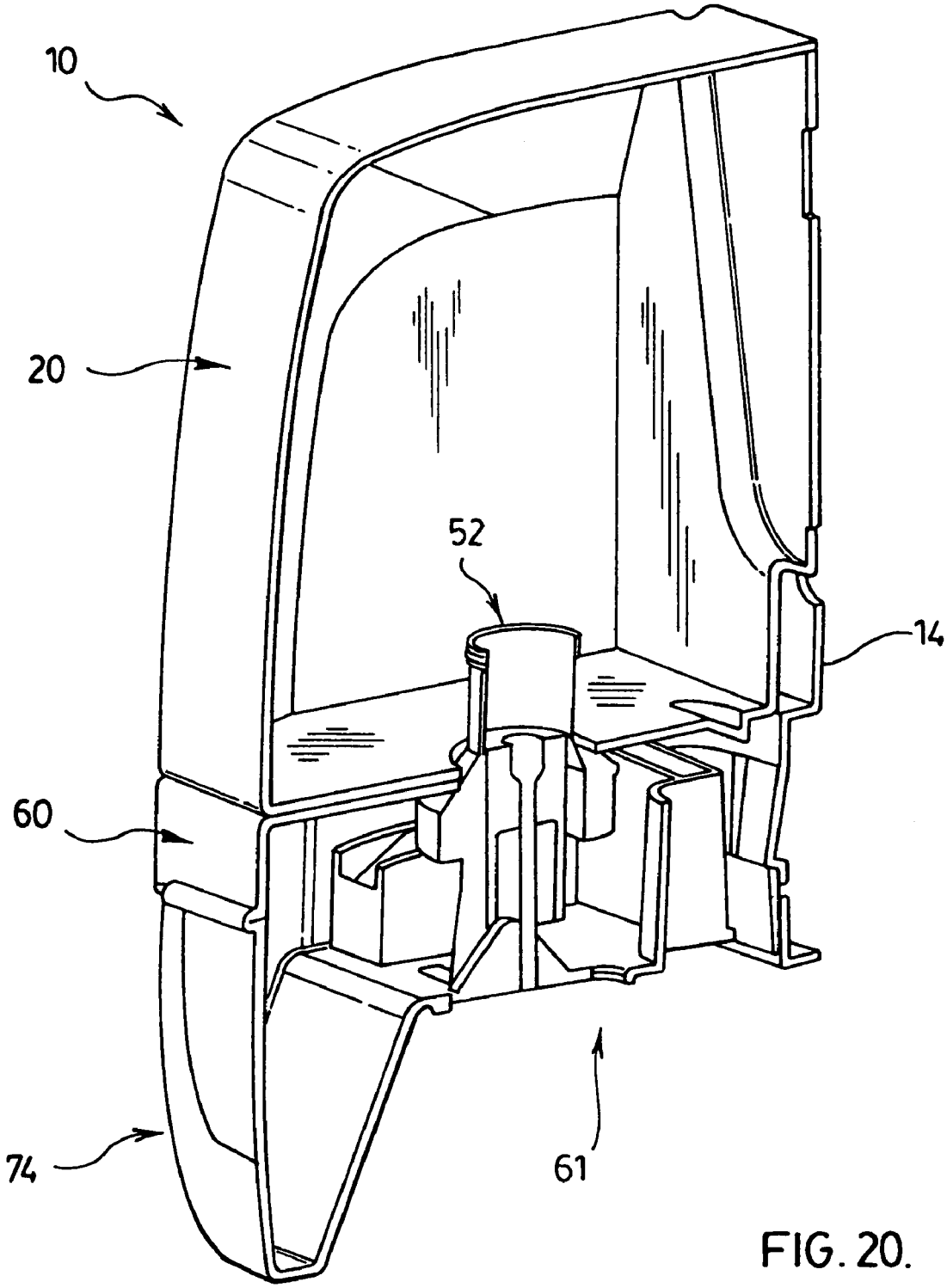
FIG. 20 is a schematic cross-section pictorial view of the dispenser shown in FIG. 2 along a central plane vertically through the dispenser.

The closed, operative position illustrated in FIGS. 16 to 19 represent a fully extended position in FIGS. 16, 17 and 18 and a retracted position in FIG. 19 effectively showing the relative range of pivoting of the support member 60 and the presser member 61 in normal operation to dispense fluid.

As shown in FIG. 13, the support member 60 has an open box-like structure with a support shelf 64 from which interconnected front wall 65, rear wall 66 and side walls 67 and 68 depend upwardly as shown. Similarly, the presser member 61 has an open box-like structure with a support shelf 69 from which interconnected front wall 70, rear wall 71 and side walls 71 and 72 depend upwardly as shown. In the presser member 61, the front wall 70 also extends downwardly beyond the shelf 69 as a front wall engagement portion 73 of a hand lever 74 having side wall portions 75 and 76 which extend downwardly from the side walls 71 and 72. A rear wall 77 of the hand lever 74 closes the rear of the hand lever 74 bridging between the engagement portion 73 and the shelf 69 and between the side wall portions 75 and 76.

As best seen in FIG. 16, the support shelf 64 of the support member 60 has an elongate opening 78 therethrough comprising an enlarged entry portion 79 at a rear end of the opening 78 and a smaller snap opening 80 at a forward end of the opening 78. Two resilient fingers are provided on either side of a rear entranceway to the snap opening 80. The snap opening 80 is adapted to be received in the slotway 32 about the neck 28 of the bottle 20 to couple the bottle 20 to the support member 60 with the resilient fingers 81 to deflect outwardly to permit the neck 28 of the bottle 20 to enter into the snap opening 80 and with the fingers 81 to assume their undeflected condition and maintain the neck 28 of the bottle securely and fixedly received within the snap opening 80 and with the bottom wall 77 of the bottle 20 supported on the support shelf 64.

In assembly of the dispensing unit 12, the piston pump mechanism 18 is coupled to the bottle 20 by threadably engaging the piston chamber forming element 52 onto the threaded neck 28 of the bottle with the piston member 53 received in the piston chamber forming element 52. The sub-assembly of the bottle 20 and the pump mechanism 18 is then coupled to the actuator member 16 by the neck 28 of the bottle carrying the piston chamber forming element 53 thereabout being inserted downwardly through the enlarged entry portion 79 of the opening 78 until the support shelf 64 is in alignment with the slotway 32 on the neck 28 between the annular flange 31 and the bottom wall 27 of the bottle. Subsequently, the bottle is moved forwardly relative to the support shelf 64 such that the snap opening 80 engages in the slotway 32 about the neck and securely engages the bottle 20 to the support member 60.

Piston Catch Fingers

The shelf 69 of the presser member 61 carries an elongate opening 83 through which the nozzle or outlet extension tube 56 of the piston member 53 is to extend.

On either side of the opening 83, the shelf 69 carries two resilient piston catch fingers 84 and 85 which are to engage the engagement flange 57 of the piston member 53 to couple the piston member 53 for movement with the presser member 61. The catch fingers 84 and 85 carry a downwardly facing catch shoulder 86 and 87 to engage an upper surface of the engagement flange 57. The shelf 69 also has two upwardly extending arms 90 and 91 on either side of the opening 83 presenting arcuate pivot shoulders 88 and 89 adapted to engage the lower surface of the engagement flange 57. The engagement flange 57 is to be received between the catch shoulders 86 and 87 and the pivot shoulders 88 and 89 such that with arcuate movement of the presser member 61 relative the support member 60, the piston member 53 may slide in linear fashion relative the support member 60 axially relative the piston chamber forming element 52.

The catch fingers 84 and 85 are resilient and adapted to be deflected away from each other so as to permit the engagement flange 576 of the piston member 53 to move past their distal ends such that after the bottle 20 and pump mechanism 18 have been secured to the support member 60, the presser member 61 may be pivoted towards the support member 61 and the distal ends of the catch fingers 84 and 85 will engage the side or lower surfaces 144 of the engagement flange 57 and be biased apart such that the catch fingers 84 and 85 will come to be disposed with their catch shoulders 86 and 87 engaging the upper surface 143 of the engagement flange 57.

As best seen in FIG. 14, the support member 60 carries on its rear wall 66 two inwardly extending hook-like catch members 94 and 95 which are adapted to be received and to slide, when the actuator member 16 is in a closed position in two slots 96 and 97 provided in the rear wall 71 of the presser member 61. Each of these slots 96 and 97 have a blind end which forms catch members 98 and 99 to engage with the catch members 94 and 95 and prevent pivoting of the presser member 61 away from the support member 60 beyond a fully extended position similar to that shown in FIG. 17. The catch members 94 and 95 are resilient such that on initial folding of the actuator member 16 from the open position to past the fully extended position, the catch members 94 and 95 will deflect to pass past the catch members 98 and 99 and prevent subsequent unfolding of the actuator member 16 past a fully extended position similar to that shown in FIGS. 16, 17 and 18.

Catch members 94 and 95 on the support member 60 engage the catch members 98 and 99 on the presser member 60 and limit pivoting of the presser member 61 away from the support member 60 to a fully extended position and thereby against pivoting to a position in which the piston member 53 may be withdrawn from the piston chamber forming member 52.

Spring Member

Two elongate spring members 100 and 101 are provided on the support member 60 extending from the support member 60 to the presser member 61 and biasing the presser member 61 to pivot about the hinge axis 62 up towards the extended position. In this regard, the spring members 100 and 101 are cantilevered leaf spring members carried by the shelf 64 of the support member 60 and extending from a rear end on the shelf 64 forwardly and away from the shelf 64 such that the spring members 100 and 101 extend out of the plane of the shelf 64. The spring members have distal second forward ends 102 and 103 to engage slide ramps 105 and 106 provided on the presser member 61. The slide ramps provide slideways 107 and 108 between two upstanding locating curbs 109 on each side of each slideway which curbs 109 assist in guiding the distal ends 102 and 103 of the spring members in sliding longitudinally along the slideways 107 and 108.

FIG. 18 shows a fully extended position in which the distal end 102 of the spring member 100 engages a forward portion of the slideway 107. FIG. 19 shows a retracted position in which the distal end 102 of the spring member 100 engages a more rearward portion of the slideway 107 than in FIG. 18. In pivoting of the presser member 61 between the extended and retracted positions, the distal end 102 of the spring member 100 slides on the slideway 107.

Each spring member 100 and 101 is elongate about a longitudinal extending along the length of the spring member. Each spring member is deflected substantially normal to its longitudinal in moving between the extended position and the retracted position.

The slideways 107 and 108 are shown to be arcuate and inclined so as to be disposed further away from the support member 60 at the forward portion which the distal end 102 engages in the extended position than at the more rearward portion which the distal end 102 engages in the retracted position. This arrangement with the slotways being progressively further from the support member 60 with distance from the forward end of the slotway assists in reducing the deflection required of the spring members to bias the presser member 61 from the retracted position to the extended position.

As seen in FIGS. 14, 15 and 16, each spring member 100 and 101 has an open box-like construction with a pair of parallel side wall forming leg members 150 and 151 joined by a bridge wall-like bight 152 and with a cross-section normal the longitudinal of the spring member appearing of U-shape. Resiliency is preferably provided to the spring members by resilient deflection of opposed portions of the legs 150 and 151 towards and away from each other.

The longitudinal of the spring members lies in a plane normal to the hinge axis 62 and in deflection of the spring members between an unbiased condition and deflected conditions, the longitudinal of the spring member remains disposed in the same plane normal to the hinge axis.

The shelf 64 of the support member 60 has two elongate slots 109 and 110 formed therein and each of the spring members 100 and 101 as seen disposed longitudinally above these slots merging with the support shelf 64 at one end of the slots.

As best seen in FIG. 18, the support member 60 has an opening 111 in its rear wall 66 exposing an edge portion 112 of the support shelf 64. This edge portion 112 serves a catch surface for engagement by a catch shoulder 113 carried on the latch member 50 of the wall plate as seen in FIG. 1. On sliding of the assembled dispensing unit 12 downwardly onto the wall plate 14 with the bottle 20 to engage the wall plate 14, the latch member 50 snaps into catching engagement on the edge portion 112 to prevent upward sliding of the dispensing unit 12 relative to the wall plate 14. The presser member 61 has its rear wall extend forwardly inwardly in a central circular portion 113 which provides a vertical passageway 114 upwardly from the bottom of the presser member 61 for a person's finger to engage the latch member 50 and to displace it rearwardly to permit removal of the dispensing unit 12 from the wall plate 14 by upward sliding. Reinforcement of the support shelf 64 of the support member 60 proximate the edge portion 112 is provided by an upstanding downwardly extending semi-circular reinforcement flange 115 provided about the rear periphery of the opening 78.

In insertion of a bottle 20 onto the support shelf 64 of the support member 60, the catch ramp 33 on the bottom wall 27 of the bottle 20 is cammed and deflect the bottom wall 47 of the bottle upwardly as the bottle moves forwardly over the edge portion 112 until the catch ramp 33 becomes fully disposed within the rear portion 79 of the opening 78 at which point in time the catch ramp 33 snaps downwardly into the opening 78. As best seen in FIGS. 12 and 13, the catch ramp 33 has a forward, inclined ramping surface 116 and an arcuate vertical rear surface 117. Engagement between the rear surface 117 and the reinforcement flange 115 about the rear of the elongate opening 78 substantially prevents the bottle from being removed from engagement with the support member 60, at least without folding the actuator member 16 to an open position to access and forcibly direct the bottom wall 27 of the bottle 20 away from the support shelf 64. The rear surface 117 of the catch ramp 33 has a curved shape complementary to the curved shape of the rear of the opening 78 and its reinforcing flange 115. This serves to accurately locate and center the bottle 20 relative to the support member 60 and to prevent relative pivoting of the bottle 20 or relative sideways movement of the bottle 20 relative to the support shelf 64.

The preferred embodiment of the actuator member 16 illustrated in FIGS. 1 to 22 is preferably injection molded as a unitary element from relatively low cost plastic, preferably low density polyethylene. It is to be appreciated therefore that each of the elements forming the actuator member 16 are formed as an integral part thereof. The spring members 100 and 101 are particularly configured to provide adequate resiliency notwithstanding that inexpensive plastic such as low density polyethylene may be used. Such plastics are known to have poor resiliency in elasticity and to become permanently deformed through repeated bending and deflection or deformation.

The dispenser unit 12 can be adapted for use as a single use disposable unit which will be discarded once the material inside the bottle 20 has been dispensed. A typical bottle size is in the range of 0.5 to two liters and, typically, fluid is dispensed in allotments in the range of about 0.5 ml to 2 ml. Thus, for example, with a one liter bottle and 0.5 ml allotments, the spring members need to be capable of enduring about 2,000 cycles before they may fail. The spring members may preferably be designed so as to fail after a certain number of cycles as, for example, 25% or 50% or 100% more cycles than required to dispense fluid from a particular bottle so as to prevent re-use of the single use dispensing unit.

The dispensing unit 12 which may be used as a single use disposable dispensing unit preferably is made from as few components as possible in order to reduce its cost. Accordingly, the actuator member 16 is being provided as a unitary element incorporating as part thereof the spring members, the living hinge, piston catch members and the other various elements. It is to be appreciated, however, that while the actuator member 16 is preferably a unitary element in accordance with the present invention, it may comprise a plurality of components. For example, rather than provide a living hinge 63 as shown in the preferred embodiment, the support member 60 and the presser member 61 may be substantially identical to that as illustrated in FIGS. 1 to 22 but as two separate elements with each having complementary hinge forming elements which would permit each of the support member 60 and presser member 61 to be formed as separate elements and, for example, snap fitted together by their hinge forming elements to form a hinge therebetween.

The spring members preferably form an integral part of one of the support member 60 or presser member 61, however, this is not necessary and separate spring members could be provided. For example, one or more helical metal coil springs to be disposed between the support member 60 and the presser member 61 to bias them apart. Such separate spring members could be used either in embodiments where the support member 60 and the presser member 61 are a unitary element joined together by a living hinge or are separate elements.

The spring members 100 and 101 have been illustrated as coupled to the support member with a distal end engaging the presser member 61. It is to be appreciated that this could be reversed and the spring members could be provided coupled to the presser member 61 with distal ends of the spring members to engage the support member 60.

The preferred integral plastic spring members 100 and 101 are shown to extend with their longitudinal in a plane normal to the hinge axis 62. This is not necessary and similar elongate cantilevered leaf spring members could be provided which extend in other directions as, for example, to extend perpendicular to the direction in which the spring members are shown in the preferred embodiment.

Each of the support member 60 and the presser member 61 are provided to have a clam shell or box-like construction including a shelf and upstanding wall such that when the actuator member 16 is closed, an overlapping closed shell or box is provided which is closed and substantially encloses in an enclosed chamber defined therein the spring members, piston catch members and piston member. This is advantageous to prevent manual access inside the closed chamber and serves to enhance the feature that the dispensing unit, once assembled, cannot be disassembled or at least resists disassembly. In this regard, the bottle 20 by reason of its catch ramp 33 becoming engaged in effectively a snap fit within the opening 78 of the shelf 64 of the support member 60 substantially prevents the bottle after it has been coupled to the support member 60 from being removed. The actuator member 16, once it has been closed, resists being unfolded to an open position by reason of the catch members 94 and 95 on the support member 60 engaging the catch members 98 and 99 on the presser member 61. Thus, once the dispensing unit 12 is assembled to form an assembly of the bottle 20, pump mechanism 18 and actuator member 16 the dispensing unit 12 substantially cannot be disassembled or at least resists disassembly.

The dispensing unit 12 of the preferred embodiment of FIGS. 1 to 22 is configured such that it must be in an assembled condition before it can be coupled to the wall plate 14.

While the dispensing unit 12 is coupled to the wall plate 14, the dispensing unit cannot be disassembled. In this regard, in order for the bottle 20 to be removed from the support plate 60, it is necessary that the support plate 60 slide horizontally rearwardly relative to the bottle. However, with the bottle 20 coupled at its rear to the wall plate 14, with the wall plate 14 extending from the bottle 20 downward immediately rearwardly of the support member 60, the wall plate 14 prevents rearward movement of the support member 60.

In the first embodiment, the assembled dispensing unit 12 is coupled to the wall plate 14 by the rear of the bottle 20 engaging the wall plate. In accordance with a modified form of the invention, the actuator member 16 and, particularly, the support member 60 thereof may also engage the wall plate 14 as, for example, by the rear wall of the support member 60 carrying its own mounting wedge similar to that provided on the bottle to be received in another wedge-shaped slot to be provided on the wall plate 14. Since the support member 60 and the wall plate 14 are to be formed by injection molding, a greater choice of coupling mechanisms for preferably slidably coupling of the support member 60 to the wall plate 14 may be provided.

In accordance with further embodiments of the invention, rather than having the bottle 20 coupled to the wall plate 14, merely the support member 60 may be coupled to the wall plate 14 for mounting of the dispensing unit 12 to the wall plate 14.

The preferred bottle 20 is a substantially, non-collapsible, substantially rigid bottle formed by blow molding. This is preferred, however, the bottle could comprise a collapsible bottle or bag, however, since the appearance of a collapsing bottle or bag is generally considered to be unappealing, the use of a collapsible bottle or bag would likely require the provision of a housing about the collapsible bottle or bag which is undesirable in respect of cost and may render the dispensing unit more susceptible to disassembly.

The preferred embodiment of the dispensing unit 12 provides for the bottle 20 to be an enclosed container as is advantageous for shipment with the assembled dispensing unit 12 inverted. The bottle 20 preferably is vented through the pump mechanism 18 in use with air to be introduced into the bottle to replace material dispensed. This is not necessary and the bottle 20 may be provided with a suitable vent hole or port open in its top wall to the atmosphere.

The preferred embodiment illustrates the dispenser unit 12 as being arranged with a bottle inverted for gravity feed of material in the bottle to the piston pump mechanism for dispensing from the opening 30 disposed at the bottom of the bottle. This is preferred but not necessary and various inverted versions of the dispensing unit could be provided for use with piston pump mechanisms having a feed tube extend downwardly into a bottle from a piston pump mechanism disposed at an opening disposed at the top of the bottle and with a nozzle from the piston member 52 extending forwardly over the presser member 61 and then downwardly.

The bottle 20 is preferably blow molded from inexpensive plastic material preferably low density polyethylene so as to provide an inexpensive bottle. The functional features of the bottle 20 have been selected having regard to the nature of this plastic material from which it is preferably made. Difficulties are typically experienced in blow molding complex structures into bottles when low cost plastics are used. The preferred bottle has been selected to have a configuration particularly with the mounting wedge 34 configured to be a relative shape and size which can be formed by inexpensive blow molding techniques commonly used.

Figure 24:
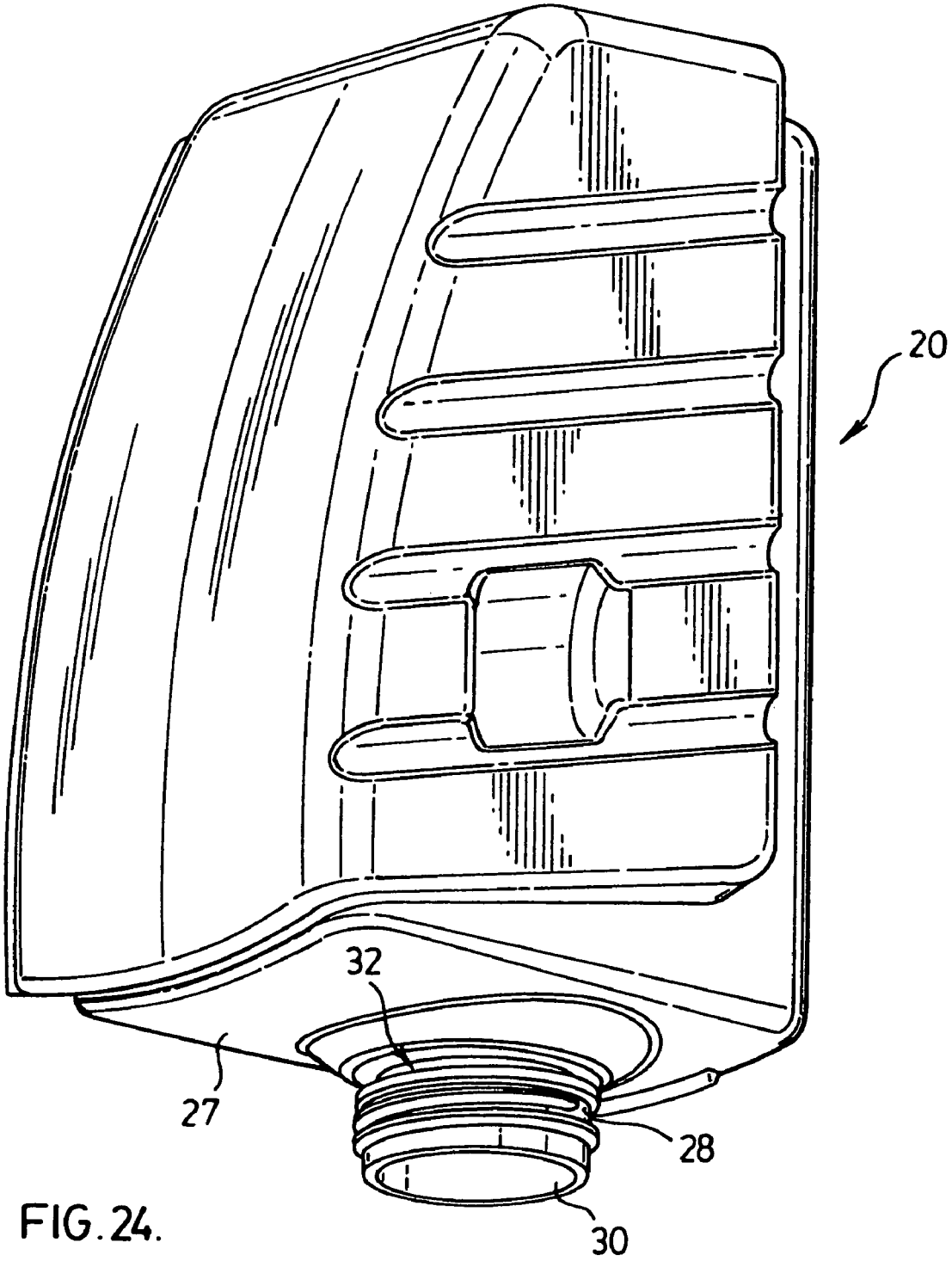
FIG. 24 is a pictorial view of the bottle of the dispenser of FIG. 23.
Figure 27:
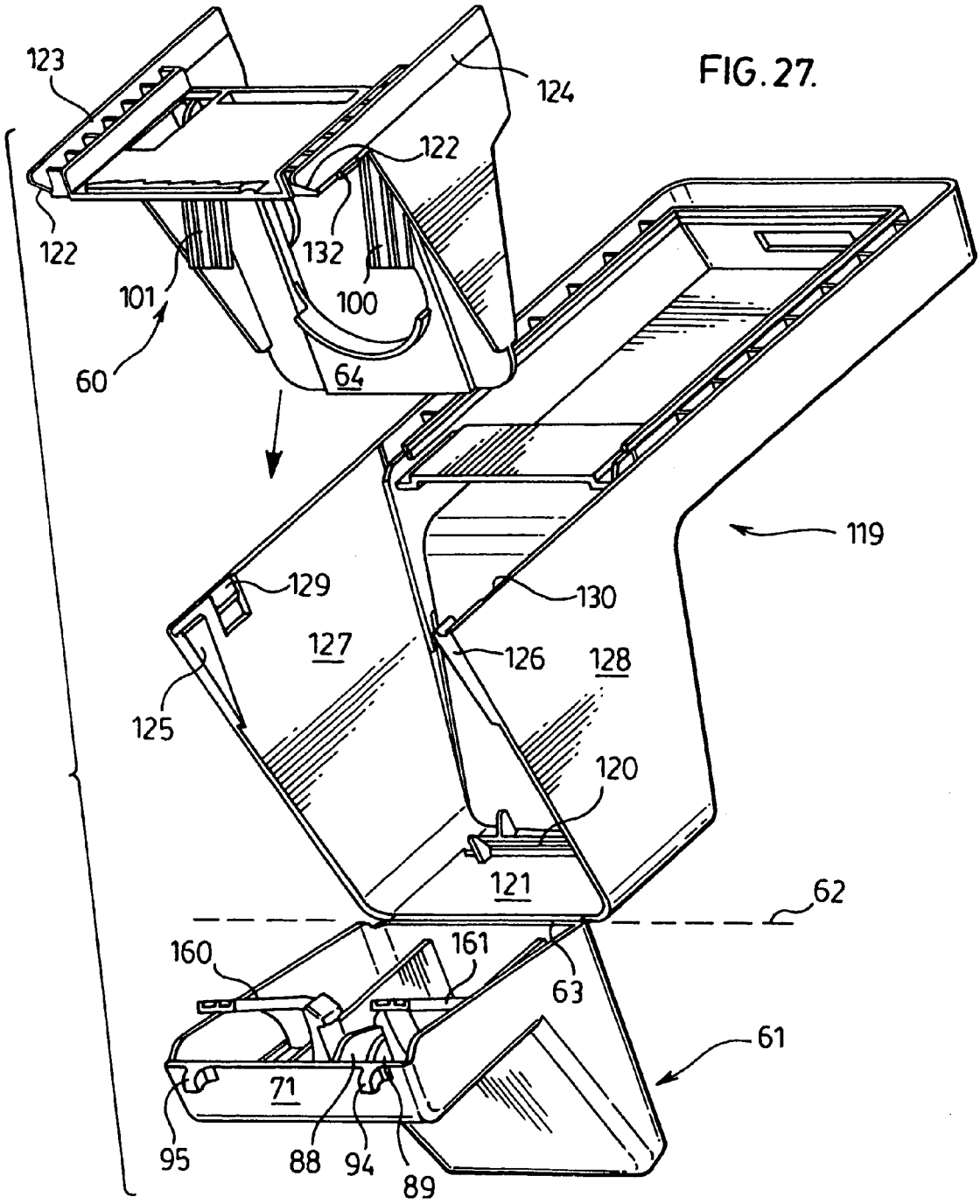
FIG. 27 is an exploded view illustrating an integral housing member and presser member with a removable support plate member for the dispenser of FIG. 23.
Figure 28:
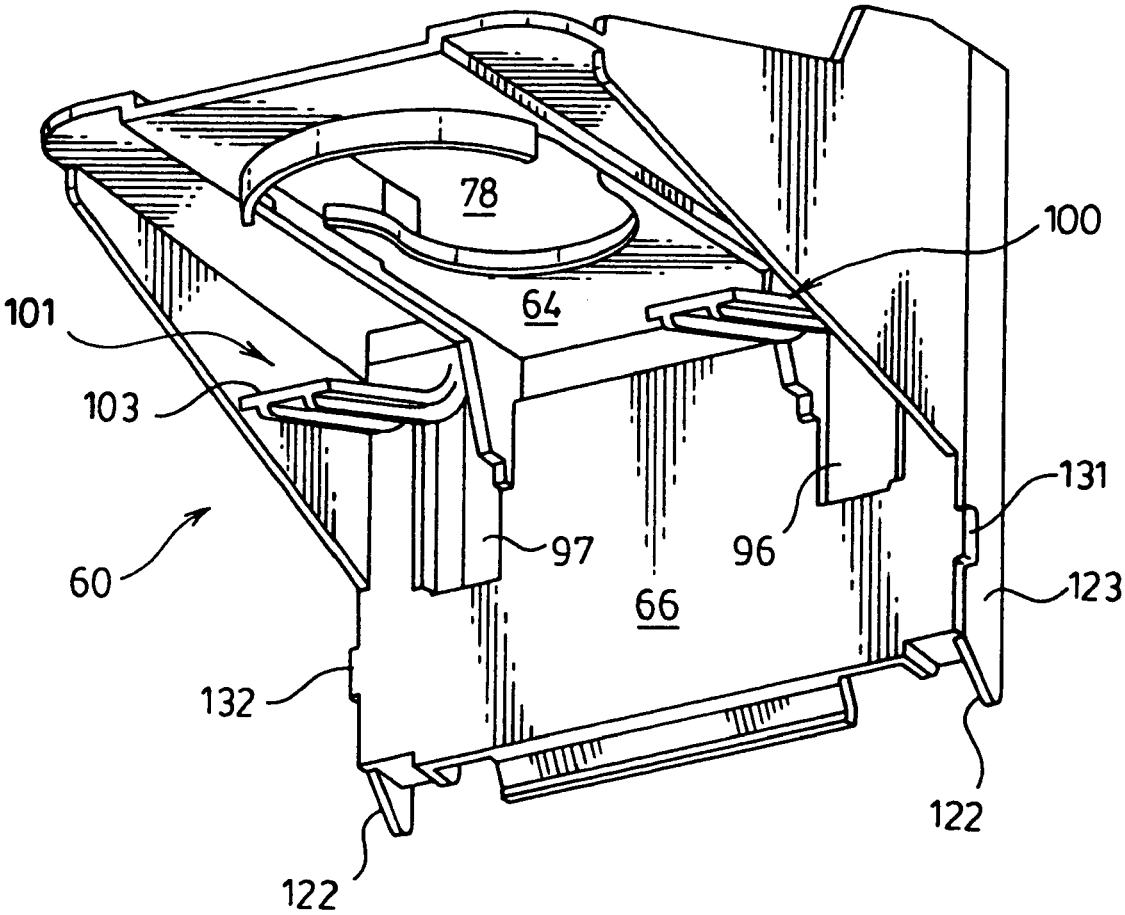
FIG. 28 is a perspective view of the support member also shown in FIG. 27.
Figure 29:
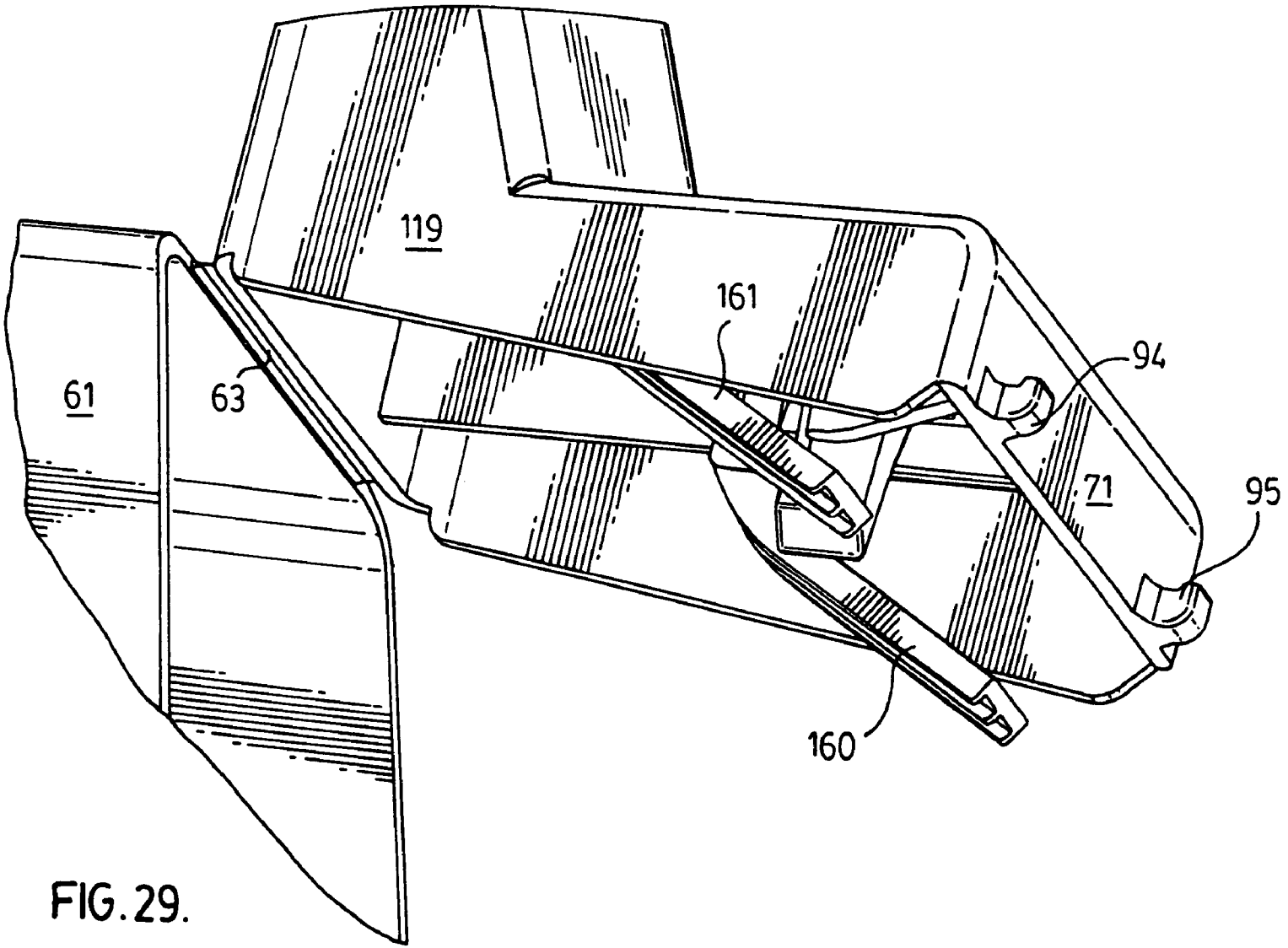
FIG. 29 is a partial perspective view of the unitary housing member and presser member shown in FIG. 27.

Reference is now made to the second embodiment of a dispenser in accordance with the present invention as illustrated in FIGS. 23 to 37. In the second embodiment, similar reference numerals are used to refer to elements similar to elements in the first embodiment. The second embodiment also shows a soap dispenser comprising a dispensing unit 12 adapted to be removably coupled to a wall plate 14 shown in FIG. 26. The dispensing unit 12 comprises an assembly of a reservoir bottle 20 shown in FIG. 24, a piston pump mechanism 18 shown in FIG. 25 and, a housing 118. The housing 118 is formed as an integral member having a housing member 119 joined by a living hinge 63 to a presser member 61 for relative pivoting about a hinge axis 62 as seen in FIG. 27. A support member 60 is removably secured to the housing member 119 to be securely received therein as, for example, to be assembled as illustrated in rear pictorial view in FIG. 30 and in side view in FIG. 31 with a front edge of a support shelf 64 being received in a support slotway 120 on a front wall 121 of the housing member 119 and with a lowermost portion 122 of each side wall 123 and 124 of the support member 60 received in support channels 125 and 126 provided at the rear lower edge of the side walls 127 and 128 of the housing member 119. The side walls 127 and 128 also carry latch channels 129 and 130 adapted to receive latch protuberances 131 and 132 carried on the side walls 123 and 124 of the support member 60 preventing rearward removal of the support member 60 other than by biasing the side walls 127 and 128 of the housing member 119 apart. When the support member 60 is assembled to the housing member 119, the support member 60 is effectively fixedly secured to the housing member 119 against relative movement and provides a housing sub-assembly.

Figure 31:
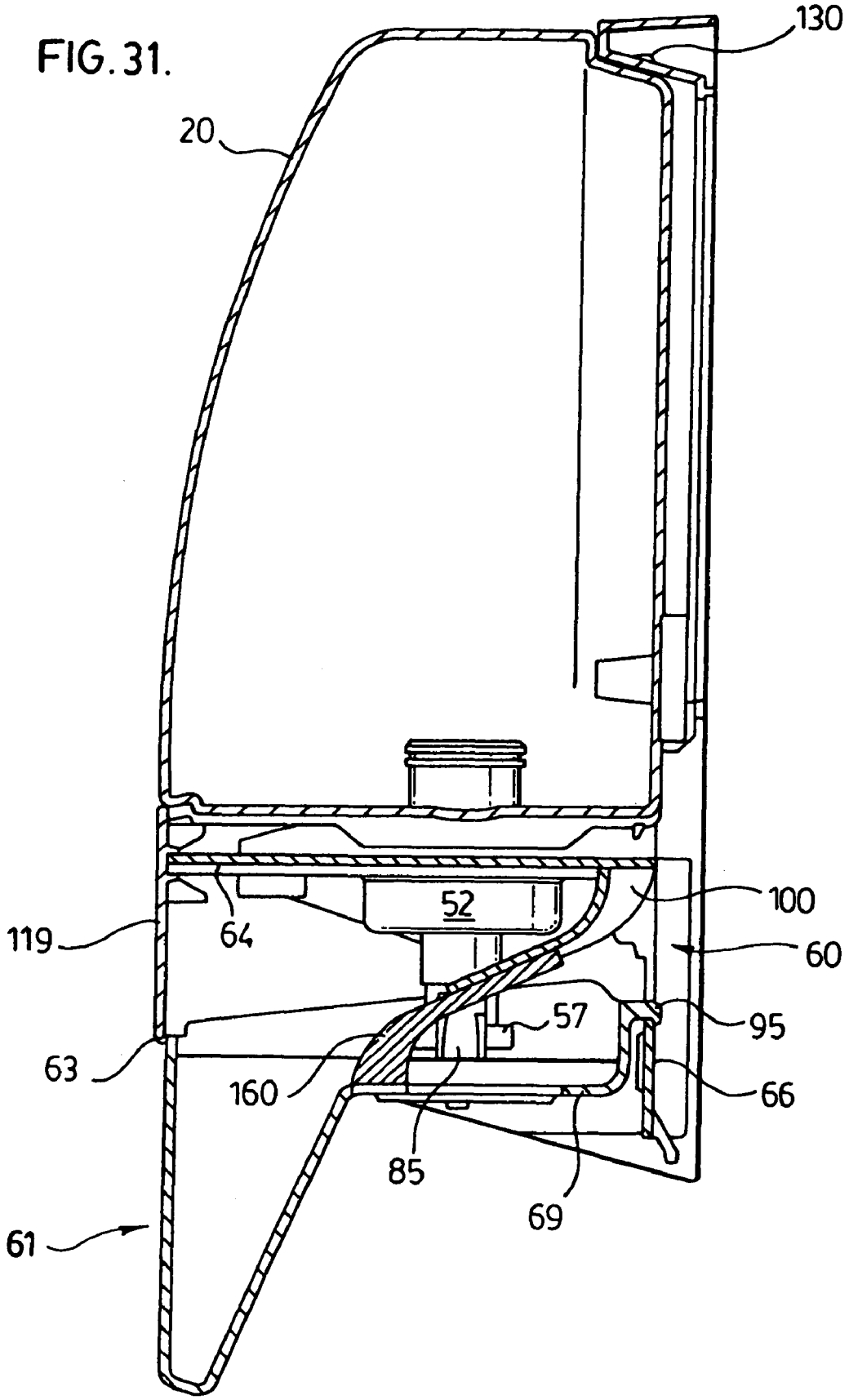
FIG. 31 is a schematic cross-sectional side view through the dispenser of FIG. 23 showing the bottle in a seated position relative to the housing member.
Figure 35:
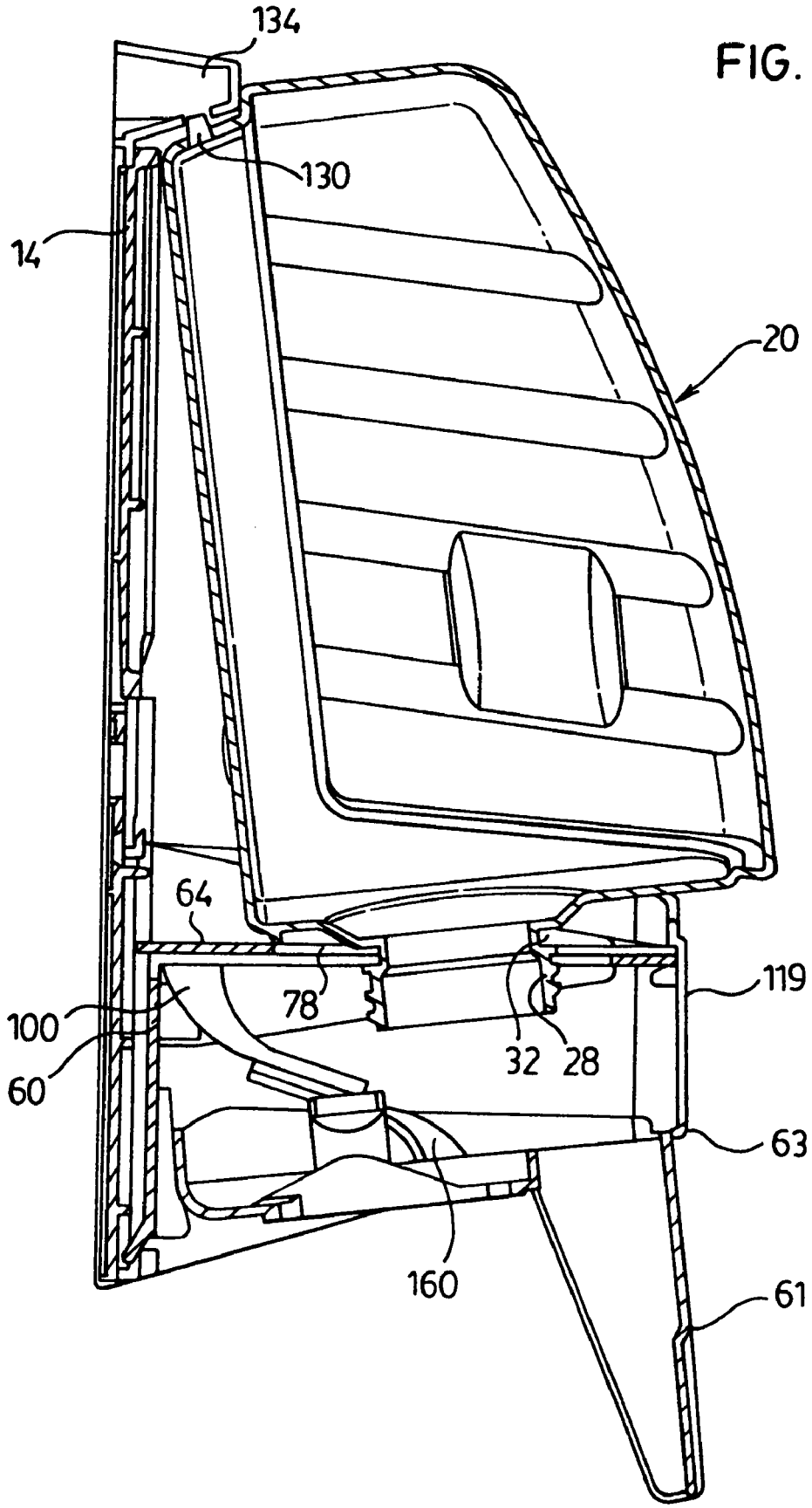
FIG. 35 is a partially cross-sectioned side view of the opposite side of the dispensing assembly to that shown in FIG. 31, however, with the bottle in an unseated position relative to the housing member ready for movement to a fully inserted seated position.

For use, the wall plate 14 is adapted to be secured to a wall. The housing sub-assembly is then coupled to the wall plate 14. The reservoir bottle 20 with the piston pump mechanism 18 pre-attached thereto as a bottle sub-assembly is coupled to the housing sub-assembly by the bottle sub-assembly being located in engagement with the housing 118 in an unseated position. The unseated position is illustrated in FIG. 35, however, for ease of illustration, without the pump mechanism 18 attached to the bottle 20, with the neck 28 of the bottle 20 extending through the elongate opening 78 of the support shelf 64, the support shelf 64 becoming received in the slotway 32 on the neck 28 of the bottle 20, and a rear central protuberance 130 at the upper rear of the bottle 20 received within a downwardly opening access opening 132 of a recess 134 provided at an upper rear of the housing member 119. From this unseated position as illustrated in FIG. 35, the lower end of the bottle 20 may be urged rearwardly effectively pivoting the bottle 20 about an effective fulcrum where the protuberance 130 engages the front of the access opening 132 such that the bottle 20 moves rearwardly in a pivoting motion to a seated position as illustrated in FIG. 31.

With such an insertion of the bottle sub-assembly in a similar manner of that described with reference to the first embodiment, two resilient piston catch fingers 84 and 85 carried on the presser member 61 engage the engagement flange 57 of the piston member 53 to couple the piston member 53 for movement with the presser member 61. In a similar manner to that described with the first embodiment, the engagement flange 57 comes to be engaged between the piston catch fingers 84 and 85 with an upper surface of the engagement flange 57 engaged by the downward facing catch shoulders 86 and 87 of the fingers and with a lower surface of the engagement flange 57 to be engaged by spaced arcuate pivot shoulders 88 and 89. In the second embodiment, the resilient piston catch fingers 84 and 85 are illustrated as being formed of plastic as integral elements to the remainder of the presser member 61.

Figure 30:
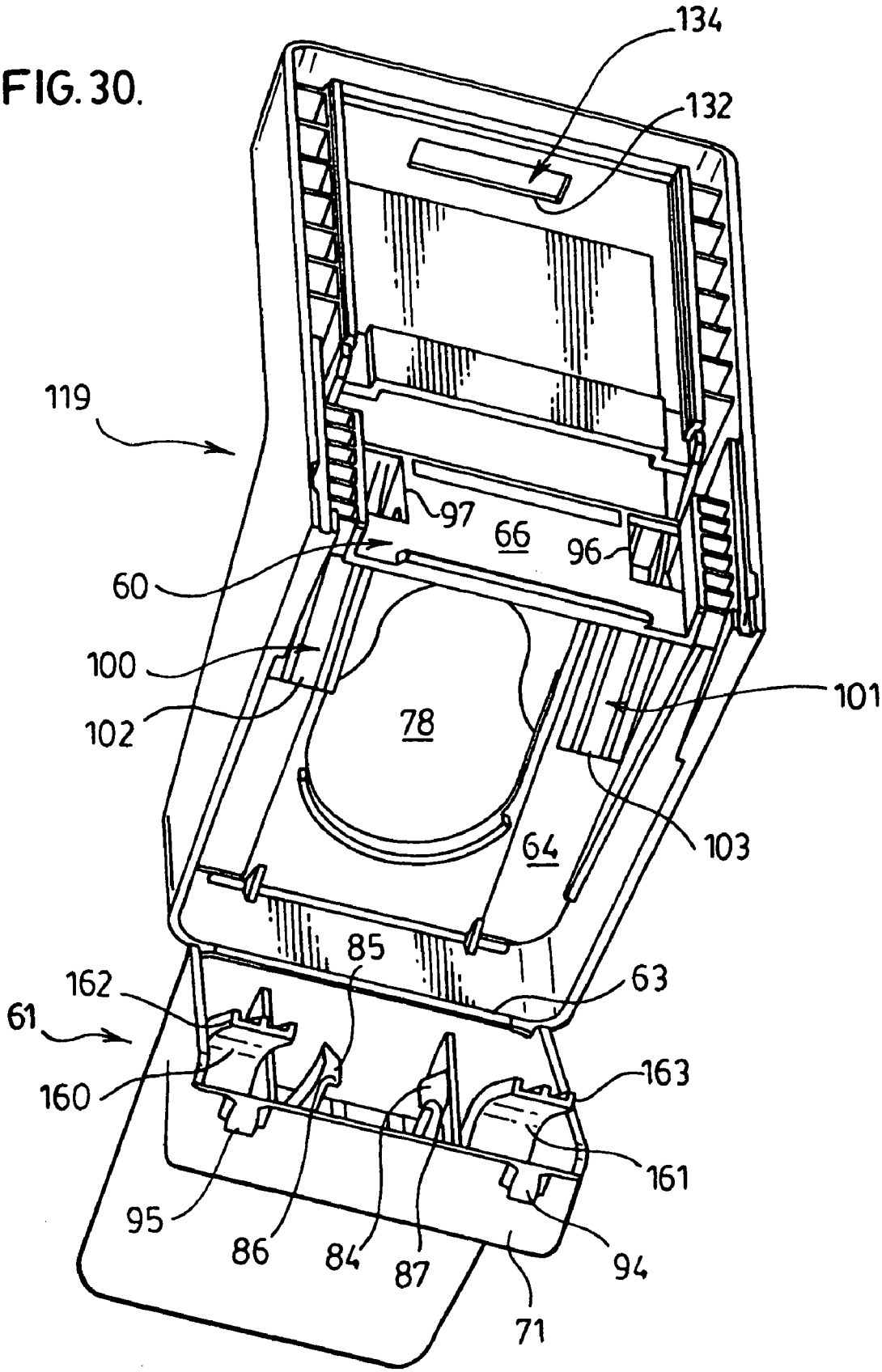
FIG. 30 is an assembled view of the housing member and presser member with the support member assembled as seen from the rear.

As in the first embodiment, the second embodiment has the support member 60 carry two elongate spring members 100 and 101 provided on the support member 60 carried on the shelf 64 and extending from a rear end on the shelf 64 forwardly and away from the shelf 64 to distal forward ends 102 and 103. However, in the second embodiment, the presser member 61 also carries two elongate spring members 160 and 161 carried by the shelf 69 of the presser member 61 and extending from a forward end of the shelf 69 rearwardly and upwardly away from the shelf 69 such that the spring members 160 and 161 extend out of the plane of the shelf 69. The spring members 160 and 161 have distal second forward ends 162 and 163 to engage the distal forward ends 102 and 103 of the spring members 100 and 101 provided on the support member 60. As seen in FIG. 30, the spring members 160 and 161 are provided outwardly from each of the piston catch fingers 84 and 85.

As seen in FIG. 30, the presser member 61 carries on its rear wall 71 two rearwardly extending hook-like catch members 94 and 95 which are adapted to be received in two slots 96 and 97 provided in the rear wall 66 of the support member 60. Each of the slots 96 and 97 have a blind end to engage with the catch members 94 and 95 on the presser member 61 and prevent pivoting of the presser member 61 away from the support member 60 beyond a fully extended position shown in FIGS. 31 and 32. From the extended position of the presser member 61 relative to the support member 60 shown in FIGS. 31 and 32, the presser member 61 may be pivoted about the hinge axis 62 to a retracted position as illustrated in FIG. 33. Reciprocal movement in a cycle between the extended position of FIG. 32 and the retracted position of FIG. 33 will move the piston member 53 of the pump mechanism 18 and dispense fluid from the bottle 20. In the range of movement between the extended position shown in FIG. 32 and the retracted position shown in FIG. 33, the spring members 100 and 101 on the support member 60 engage the spring members 160 and 161 on the presser member 61 and bias the presser member 61 to pivot about the hinge axis 62 towards the extended position.

Figure 34:
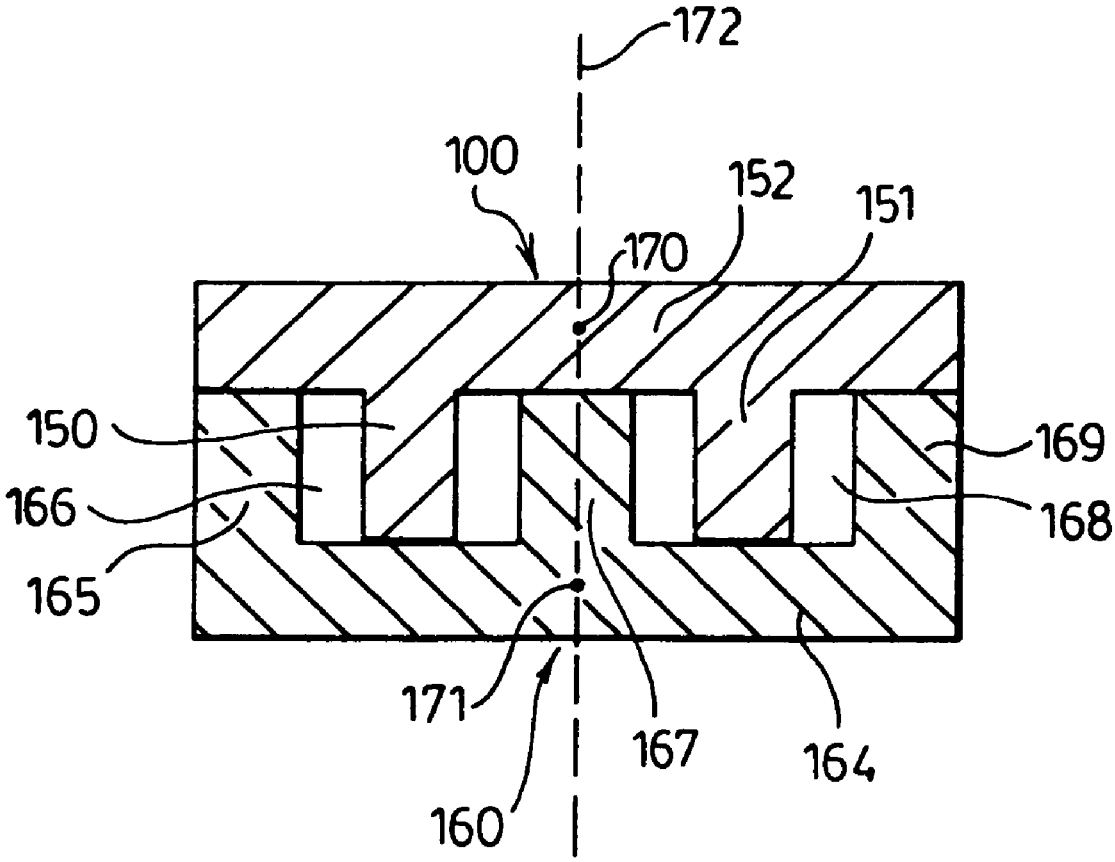
FIG. 34 is a cross-sectional side view along section line 8-8' of the spring elements in FIG. 32.

Reference is made to FIG. 34 which illustrates a cross-sectional side view through the spring members 100 and 160 along section lines 8-8' in FIG. 32. As seen, the spring member 100 has an elongate web 152 and a pair of parallel flanges or leg members 150 and 151 extending normal to the web 152. The spring member 160 of the presser member 61 similarly have an elongate web 164 and three parallel leg members 165, 167 and 169 extending normal to the web 164. As seen in cross-section in FIG. 34, the flange-like legs 150 and 152 of the spring member 100 of the support member 60 are received in the channels 166 and 168 between the legs 165, 167 and 169 of the spring member 160 contacting the web 164 therebetween. Similarly, the three legs 165, 167 and 169 of the spring member 160 engage the web 152 of the spring member 100 on either side of the legs 150 and 151. The legs 150 and 151 on the spring member 100 effectively form with the portion of the web 152 therebetween a U-shaped member. Any two of the legs 165, 167 and 169 with the web 164 therebetween also form a U-shape member on spring member 160. The nesting of a leg of one spring member in the channel between the legs of the other spring member provide an advantageous structure such that the opposed spring members 100, 101 which engage the spring members 160, 161, respectively, will be maintained longitudinally of each other with displacement prevented of any one of the spring member laterally relative another opposite spring member that they will not become disengaged from each other.

As seen in side view in FIGS. 32 and 33, the extent to which any one of the flange-like legs 150, 151, 165, 167 and 169 extend from their respective webs 152 and 164 is greatest at a first end of the respective spring member where it is coupled to its respective support member 60 or presser member 61 and decreases towards its remote distal end. This is believed to be advantageous to distribute the locations where the spring members may resiliently deform.

The spring members preferably have a U-shape in cross-section with the legs perpendicular to the web. It is to be appreciated that other shapes such as T-shapes, L-shapes and the like are suitable in providing a beam with resistance to deflection both in the common plane and laterally. Any one of the two opposing beam member needs to have resistance to deflection laterally when the beams nest or otherwise engage each other to prevent relative lateral deflection. The legs do not need to extend parallel to the common plane and may, for example, extend laterally to the side at an angle as, for example, with a V-shape.

The beam members illustrated have a contact side-to-side width along their length. This is not necessary and the width may vary in distance from the first end.

Deformation of a spring member preferably occurs, at least in part, by deflection of the legs of the spring member inwardly and outwardly towards or away from legs on the same spring member, that is, sideways as seen in FIG. 34.

Each spring member extends longitudinally about a longitudinal axis. The longitudinal axis is schematically illustrated respectively as 170 and 171 for the spring member 100 and 160 in FIG. 34 and extending the length of each spring member 100, 160 centrally along its respective web 152, 164. In deflection of each of the spring members, the spring members are resiliently deflectable from an unbiased condition to a deflected condition in a direction generally normal to this longitudinal and preferably in any spring member deflecting between the unbiased condition and the deflected conditions in moving the longitudinal of the spring member remains disposed in a common, flat plane illustrated, for example, as 172 in FIG. 34. The flat plane 172 in which the longitudinal of each spring member moves preferably is normal to the hinge axis 62.

As best seen in FIGS. 32 and 33, each of the webs 152 and 164 of the spring members 100 and 160 extend from their respective first end as a relatively curved portion merging into a relatively straight portion proximate their distal end. The straight portions of the opposed spring members overlap where there is engagement between the opposed spring members and with pivoting of the presser member 61 relative to the support member 60, the straight portions of each of the opposed spring members are permitted to slide longitudinally relative each other.

In the second embodiment in accordance with FIGS. 23 to 36, the presser member 61 including the spring members 160 and 161 is formed as integral member from plastic as by injection molding.

Figure 36:
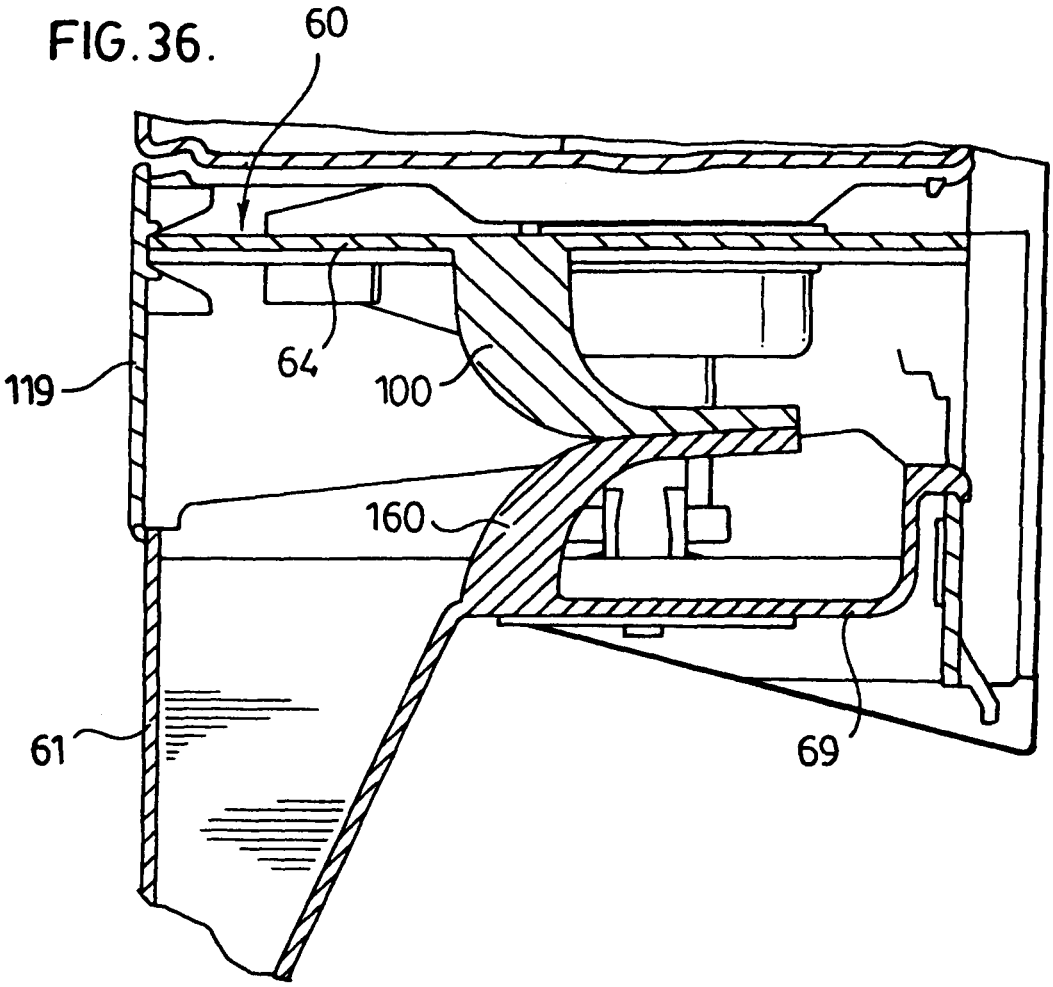
FIG. 36 is a cross-sectional side view as in FIG. 32 but showing modified spring members.

Reference is made to FIG. 36 which is a cross-section identical to that illustrated in FIG. 32, however, modified from that shown in FIG. 32 such that each the spring member 100 carried on the support member 60 and the spring member 160 carried on the presser member 61 extend rearwardly. This is to be contrasted with FIG. 32 in which one spring member extends forwardly to its distal end and the other extends rearwardly to its distal end. Similarly, both of the opposed spring members may be provided such that their distal ends extend forwardly. Selection of the location of the spring members and the direction in which they extend may be made having regard to the other elements and features which are to be desired to be provided on the support member and the presser members on which the spring members are to be supported.

The first embodiment of FIGS. 1 to 22 illustrate elongate cantilevered spring members 100 and 101 provided on the support member 60 to engage engagement ramps 107 and 108 on the presser member 61. An arrangement similar to that illustrated in the first embodiment, notably in FIG. 13, could be modified so as to provide, in replacement of the engagement surfaces 107 and 108, a second set of spring members on the presser member 61 similar to the spring members 160 and 161 in the second embodiment.

In the second embodiment, two pairs of spring mechanism are provided, each pair comprising a spring member carried on the presser member 61 to engage another spring member provided on the support member 60. Each of the spring mechanisms is adapted to have their elongate spring members extend along a longitudinal and to deflect with their longitudinal maintained in a common flat plane perpendicular to the hinge axis 62 with each of the common planes spaced from each other along the spring axis 62 and disposed to reside on opposite sides of the neck of the bottle 20.

The second embodiment of FIGS. 23 to 37 illustrates, as in FIG. 30, a housing sub-assembly formed from two parts from the support member 60 and the housing 118 consisting of the housing member 119 and the actuator member 61. It is to be appreciated that a not dissimilar housing sub-assembly could be formed, if desired, as a unitary part of plastic by injection molding as in the manner of the actuator 16 shown in FIG. 13, however, with an upwardly extended rear wall portion.

The preferred embodiments illustrate the spring members being formed as integral elements with the presser member 61 or support member 60 from which they depend. This is not necessary and is to be appreciated that, while not typically preferred, each of the spring members could be provided as a separate element to be received, for example, in a suitably strong socket as in a sliding manner or the like on their, for example, respective presser member 61 or support member 60.

The cantilevered spring members need not be made from plastic material but be made, while considered to be less preferred, from other materials including spring metal, preferably, continuing to have a similar shape as to the webs and legs. Whether or not the spring members may be formed from plastic or from other materials such as metal, the construction of the spring member to extend along this longitudinal, adapted to deflect normal to the longitudinal and including the web having legs extending away from the web, preferably perpendicular thereto and parallel to its longitudinal, is an advantageous configuration. Providing the spring members to be separate elements which are removable can have the advantage of permitting different plastic or other materials to be used to form the spring members.

Figure 37:
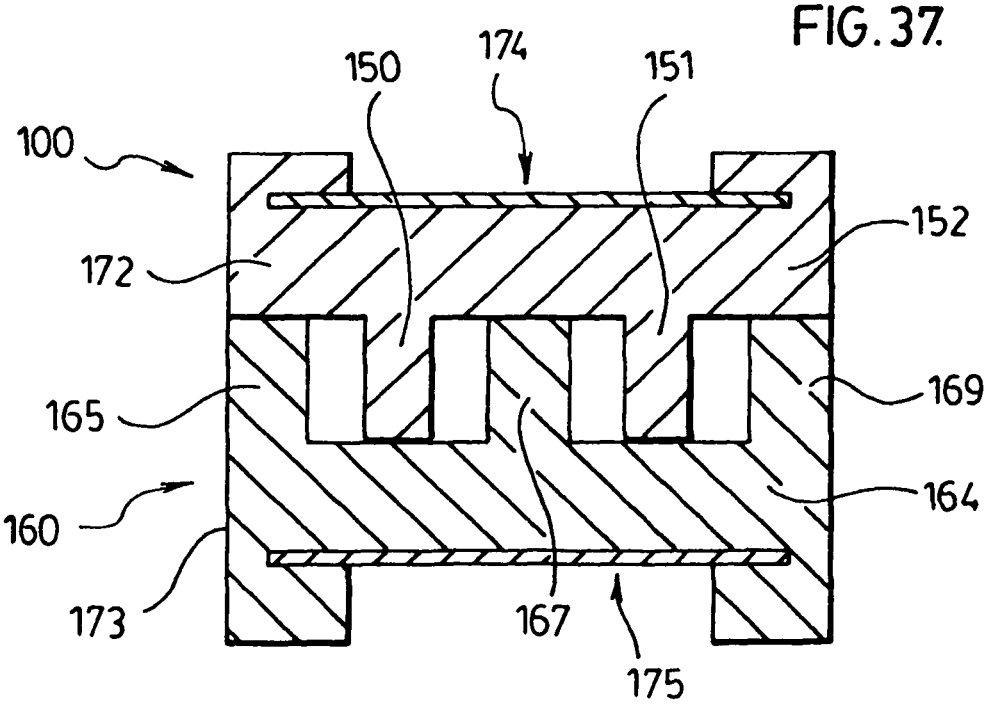
FIG. 37 is a cross-sectional view identical to that in FIG. 34, however, showing an alternate composite version of a spring member.

The spring members may comprise a composite of a plastic member, preferably integrally formed with the presser member 61 or support member 60 from which it depends, together with a metal spring member. In this regard, FIG. 37 shows a modified cross-section to that illustrated in FIG. 34 in which each spring member 100 and 160 have an elongate channel 172 or 173 disposed along the length of this web 152 and 164 and adapted to receive a flat thin piece of spring metal 174 or 175 which has an inherent tendency to assume a preset configuration. Such a composite plastic and metal spring member may be advantageous to ensure that the plastic spring will maintain operative characteristics as, for example, under temperature conditions beyond that normally to be experienced in heated and air conditioned work and living premises.

Each of the first and second embodiments show use of a living hinge to couple the presser member 61 to another element to permit relative pivoting. This is advantageous but is not necessary. For example, the presser member 61 and living hinge 63 illustrated in both embodiments may be replaced by a separate presser member which is adapted to be coupled as by a hinge including, for example, axle members for pivoting relative to the element to which the presser member is coupled.

The preferred embodiments illustrate the use of preferred spring members in accordance with the present invention in a context where they are to bias apart two elements which are pivotally mounted for pivoting relative to each other. This is not necessary and it is to be appreciated that similar spring members to those illustrated could be utilized as for biasing apart members which are to slide linearly or otherwise move relative to each other between two positions. For example, a presser member could be provided coupled to a piston directly for reciprocal movement as a slide member parallel to the movement of the piston and with suitable spring members in accordance with the present invention provided to bias such a slide member.

Whether or not living hinges are used to provide hinge mechanisms, in accordance with the present invention, a dispensing apparatus can be formed entirely with plastic as, for example, as illustrated in the second embodiment in which the spring members 100, 101 and 160, 161 as well as the piston catch fingers 84 and 85 are formed together with the remainder of the actuator member 61 as a unitary element of plastic formed as by injection molding.

While the invention has been described with reference to preferred embodiments, many modifications and variations will now occur to a person skilled in the art. For a definition of the invention, reference is made to the following claims.

We claim:

1. A dispenser for flowable materials comprising:

a support member, an actuator member reciprocally movable relative to the support member between an extended position and a retracted position to dispense flowable material, a spring mechanism comprising a spring member biasing the actuator member to one of the extended position and the retracted position, the spring member comprising an elongate cantilevered spring member extending along a longitudinal from a first proximal end to a second distal end, wherein either:

(a) the first proximal end is coupled to the support member and the second distal end engaging the actuator member, or (b) the second distal end is coupled to the actuator member and the first proximal end engaging the support member, wherein the spring member having an unbiased condition and being resiliently deflectable generally normal to its longitudinal to deflected conditions from which the spring member inherently attempts to return to its unbiased condition, the longitudinal of the spring member remaining disposed in a flat plane in deflecting between the unbiased condition and the deflected conditions, the spring member comprising a pair of spaced leg members joined by a central bight, the spring member having in cross-section normal to its longitudinal a U-shape with the leg members spaced from each other and with the bight extending between the leg members normal to the flat plane.

2. A dispenser as claimed in claim 1 wherein the spring member is provided with resiliency substantially by the resilient deflection of opposed portions of the two leg members towards and/or away from each other normal to the flat plane.

3. A dispenser as claimed in claim 2 wherein the spring member consists of plastic material.

4. A dispenser as claimed in claim 3 wherein the spring member together with one of the presser member and the support member comprise a unitary element injection molded from plastic as a unitary element.

5. A dispenser as claimed in claim 1 wherein the support member is pivotally coupled to the actuator member for pivoting about a hinge axis and the flat plane is normal to the hinge axis.

6. A dispenser as claimed in claim 5 wherein the spring mechanism comprises identical pairs of the spring member, the flat plane of each spring member spaced from the flat plane of each other spring member.

7. A dispenser as claimed in claim 1 wherein an elongate slideway is provided on one of the support member and the actuator member for engagement by the second distal end of the spring member with the second distal end of the spring member sliding longitudinally on the slideway as the actuator member and the support member move relative each other between the extended position and the retracted position.

8. A dispenser as claimed in claim 2 wherein each leg member lies in a plane parallel to the flat plane.

9. A dispenser as claimed in claim 3 wherein each leg member lies in a plane parallel to the flat plane.

10. A dispenser as claimed in claim 4 wherein each leg member lies in a plane parallel to the flat plane.

* * * * *